US007482104B2

(12) United States Patent
Kondo et al.

(10) Patent No.: US 7,482,104 B2
(45) Date of Patent: Jan. 27, 2009

(54) TONER, DEVELOPER, TONER CONTAINER AND LATENT ELECTROSTATIC IMAGE CARRIER, AND PROCESS CARTRIDGE, IMAGE FORMING METHOD, AND IMAGE FORMING APPARATUS USING THE SAME

(75) Inventors: Maiko Kondo, Ebina (JP); Hidetoshi Kami, Numazu (JP); Naohiro Toda, Yokohama (JP); Ryoichi Kitajima, Numazu (JP); Hiroshi Nagame, Numazu (JP); Narihito Kojima, Numazu (JP); Yoshiaki Kawasaki, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/103,904

(22) Filed: Apr. 16, 2008

(65) Prior Publication Data

US 2008/0193865 A1 Aug. 14, 2008

(30) Foreign Application Priority Data

Dec. 9, 2003 (JP) ..... 2003-409888
Apr. 9, 2004 (JP) ..... 2004-115639

(51) Int. Cl.
*G03G 9/08* (2006.01)

(52) U.S. Cl. ..... 430/66; 430/108.6; 430/110.3; 430/111.3

(58) Field of Classification Search ..... 430/66, 430/108.6, 110.3, 111.3
See application file for complete search history.

(56) References Cited

U.S. PATENT DOCUMENTS 2,297,691 A 10/1942 Carlson
4,740,441 A 4/1988 Otomura
4,942,104 A 7/1990 Kitajima et al.
5,008,172 A 4/1991 Rokutanzono et al.
5,059,502 A 10/1991 Kojima et al.
5,147,751 A 9/1992 Kojima et al.
5,264,903 A 11/1993 Nagame et al.
5,339,138 A 8/1994 Mishima et al.

(Continued)

FOREIGN PATENT DOCUMENTS

JP 63-55562 3/1988

(Continued)

*Primary Examiner*—John L Goodrow
(74) *Attorney, Agent, or Firm*—Oblon, Spivak, McClelland, Maier & Neustadt, P.C.

(57) ABSTRACT

An image forming method, includes: forming a latent electrostatic image on a latent electrostatic image carrier; developing the latent electrostatic image with a toner to thereby form a visible image; transferring the visible image to a recording medium; and fixing the image transferred to the recording medium. The latent electrostatic image carrier includes: a support, a photoconductive layer on the support, and a surface protective layer on the support. The surface protective layer includes a reactant made by cross-linking the following: an electric charge transporting material which comprises a reactive functional group, a cross-linking resin, and a fluorine surfactant. The toner comprises an inorganic fine particle which defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF-2/100} \quad \text{Equation (1)}$$

where SF-2 denotes a shape factor of the toner.

14 Claims, 5 Drawing Sheets

U.S. PATENT DOCUMENTS 5,390,015 A 2/1995 Nagame et al.
5,452,061 A 9/1995 Kojima et al.
5,525,447 A 6/1996 Ikuno et al.
5,656,406 A 8/1997 Ikuno et al.
5,667,926 A 9/1997 Maruyama et al.
5,840,455 A 11/1998 Ikuno et al.
5,870,657 A 2/1999 Nagame et al.
5,871,876 A 2/1999 Ikuno et al.
6,014,532 A 1/2000 Takeichi et al.
6,030,733 A 2/2000 Kami et al.
6,060,205 A 5/2000 Takeichi et al.
6,118,964 A 9/2000 Kojima et al.
6,151,468 A 11/2000 Kami et al.
6,160,977 A 12/2000 Takeichi et al.
6,326,112 B1 12/2001 Tamura et al.
6,363,237 B1 3/2002 Nagame et al.
6,432,596 B2 8/2002 Ikuno et al.
6,521,386 B1 2/2003 Sakon et al.
6,521,387 B2 2/2003 Kawasaki
6,558,862 B2 5/2003 Kojima et al.
6,558,863 B2 5/2003 Rokutanzono et al.
6,562,529 B1 5/2003 Kojima et al.
6,573,016 B2 6/2003 Kami et al.
6,576,388 B2 6/2003 Sakon et al.
6,593,048 B2 7/2003 Sasaki et al.
6,641,964 B2 11/2003 Ikuno et al.
6,653,033 B1 11/2003 Kami et al.
6,667,141 B2 12/2003 Iwamoto et al.
6,686,114 B2 2/2004 Sakon et al.
6,699,632 B2 3/2004 Higuchi et al.
6,706,459 B2 3/2004 Kojima et al.
6,790,572 B2 9/2004 Tamoto et al.
6,790,575 B2 9/2004 Sasaki et al.
6,811,944 B2 11/2004 Higuchi et al.
6,813,461 B2 11/2004 Higuchi et al.
6,824,939 B2 11/2004 Kurimoto et al.
6,852,462 B2 2/2005 Emoto et al.
2002/0081513 A1 6/2002 Higuchi et al.
2002/0159797 A1 10/2002 Matsuda et al.
2003/0077531 A1 4/2003 Suzuki et al.
2003/0082472 A1 5/2003 Kondo et al.
2003/0099481 A1 5/2003 Sampe et al.
2003/0108362 A1 6/2003 Ohjimi et al.
2003/0113642 A1 6/2003 Kami et al.
2003/0152854 A1 8/2003 Kojima et al.
2003/0165760 A1 9/2003 Higuchi et al.
2003/0194627 A1 10/2003 Ikegami et al.
2003/0215726 A1 11/2003 Sugino et al.
2003/0219279 A1 11/2003 Nohsho et al.
2004/0028435 A1 2/2004 Kurimoto et al.
2004/0048178 A1 3/2004 Ikuno et al.
2004/0053149 A1 3/2004 Toda et al.
2004/0053154 A1 3/2004 Tomita et al.
2004/0076443 A1 4/2004 Suzuki et al.
2004/0120730 A1 6/2004 Nimi et al.
2004/0126147 A1 7/2004 Kondo et al.
2004/0126686 A1 7/2004 Toda et al.
2004/0126687 A1 7/2004 Ikegami et al.
2004/0126689 A1 7/2004 Tamoto et al.
2004/0142265 A1 7/2004 Tomita et al.
2004/0146795 A1 7/2004 Emoto et al.
2004/0185358 A1 9/2004 Kami
2004/0197688 A1 10/2004 Tamoto et al.
2004/0209181 A1 10/2004 Higuchi et al.

FOREIGN PATENT DOCUMENTS

JP 8-278673 10/1996
JP 2000-112169 4/2000
JP 2001-13767 1/2001
JP 2003-207919 7/2003

TONER, DEVELOPER, TONER CONTAINER AND LATENT ELECTROSTATIC IMAGE CARRIER, AND PROCESS CARTRIDGE, IMAGE FORMING METHOD, AND IMAGE FORMING APPARATUS USING THE SAME

BACKGROUND OF THE INVENTION

1. Field of the Invention

The present invention relates to a toner, a developer, a toner container and a latent electrostatic image carrier used for laser beam printer, facsimile, digital copier and the like. The present invention also relates to a process cartridge, an image forming method and an image forming apparatus using the above.

2. Description of the Related Art

Generally, an image forming method of an electrophotography imparts electric charge to a surface of an electrophotographic photoconductor by discharge, to thereby form a latent electrostatic image thereon by an exposure. Then, the latent electrostatic image on the photoconductor is to be developed with a toner, to thereby form a toner image. Thereafter, the toner image is to be transferred to a conveyed recording member such as paper and the like. The thus transferred toner image is to be fixed on the recording member, thus bringing about a final image.

A photoconductor used for the above image forming method, conventionally, was mainly an inorganic photoconductor such as selenium, zinc oxide, cadmium sulfide and the like. Presently, however, an organic photoconductor (OPC) is widely used in place of the inorganic photoconductor, due to its advantages such as selectivity of materials causing small pollution to the global environment, low manufacturing cost, high selectivity of exposing light source.

Due to its low mechanical strength, however, the organic photoconductor may cause wear to a photoconductive layer after repeated operations, failing to obtain sufficient chargeability, sensitivity and the like which are required properties.

Moreover, the organic photoconductor may cause image blur when ozone, NOx and the like adhere to a top surface, where the ozone, NOx and the like are caused by corona discharge in repeated copying processes, mainly in a charging operation. Moreover, the organic photoconductor may cause low resistance of the photoconductor's surface due to a filming phenomenon, thus lowering an image density. Herein, in the filming phenomenon, paper powder and the like caused when paper is used for a recording medium of fine-powder toner adhere to the photoconductor's surface. The above-described are problematical.

In sum, such a technology is desired as can continuously keep an initial photoconductor property by efficiently removing deposit even when a top surface of the organic photoconductor is polished gradually by some units after long-term repeated operations.

To meet the above requirement, for example, the following method is proposed: for an organic photoconductor having a surface protective layer made from a fluorine-contained amorphous silicon carbide or an amorphous carbon, using a toner which contains polishing fine particles meets both wear resistance and deposit removal (refer to Japanese Patent Application Laid-Open (JP-A) No. 2001-42551). The above proposed method is, however, high in manufacturing cost for film forming of the protective layer, thus lacking practicality.

Moreover, for example, the following method is proposed: for an organic photoconductor having a surface protective layer in which high-hardness fine particles are dispersed, a developer added by fine particles capable of functioning as polishing material is used (refer to JP-A No. 2001-228645). In this proposed method, however, dispersing the fine particles in the surface protective layer may decrease contact efficiency between a cleaning member and a photoconductor's surface, decreasing cleanability of toner remaining after transfer.

Moreover, for example, the following method is proposed: for an organic photoconductor having specified mass ratio of an electric charge mobile material and a polycarbonate, a toner having specified addition amount of additive is used, for meeting both wear resistance and filming resistance (refer to JP-A No. 2002-244314). This proposed method, however, does not satisfy rapid desire for higher durability, which is a problem in view of wear resistance of the photoconductor.

OBJECTS AND ADVANTAGES

It is an object of the present invention to provide a toner, a developer, a toner container and a latent electrostatic image carrier which are capable of obtaining a good image free from abnormal images such as those having image density decrease, image blur and the like, even after a long-term repeated operations. It is another object of the present invention to provide a process cartridge, an image forming method and an image forming apparatus which use the above.

SUMMARY OF THE INVENTION

After studying hard to solve the above issues, the present inventors have found out the following: When an organic photoconductor (as an electrophotographic photoconductor) having at least a photoconductive layer and a surface protective layer on a support is used and the surface protective layer constituted of a linear high molecular material such as general polycarbonate is used, cutting even one portion of a molecular chain causes wear continuously. Moreover, after further studying based on the above finding, the present inventors have found out the following: Use of a cross-linking resin having a chemical bonding in a form of a mesh, namely, a mesh-structured resin may bring about still higher wear resistance, which is free from wear even when a bonding of the high molecular chain is partly broken.

According to a first aspect of the present invention, there is provided an image forming method, comprising: forming a latent electrostatic image on a latent electrostatic image carrier; developing the latent electrostatic image with a toner to thereby form a visible image; transferring the visible image to a recording medium; and fixing the image transferred to the recording medium. The latent electrostatic, image carrier comprises: a support, a photoconductive layer on the support, and a surface protective layer on the support. The surface protective layer comprises a reactant made by cross-linking the following: an electric charge transporting material which comprises a reactive functional group, a cross-linking resin, and a fluorine surfactant. The toner comprises an inorganic fine particle which defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF-2/100} \qquad \text{Equation (1)}$$

where SF-2 denotes a shape factor of the toner.

With this, a good image may be obtained that is free from abnormal images such as those having image density decrease, image blur and the like, even after a long-term repeated operations.

According to a second aspect of the present invention, there is provided an image forming apparatus, comprising: a latent electrostatic image carrier; a forming unit configured to form a latent electrostatic image on the latent electrostatic image carrier (1, 24, 101, 15); a developing unit configured to develop, with a toner, the latent electrostatic image, to thereby form a visible image; a transferring unit configured to transfer the visible image to a recording medium; and a fixing unit configured to fix the image transferred to the recording medium. The latent electrostatic image carrier comprises: a support, a photoconductive layer on the support, and a surface protective layer on the support. The surface protective layer comprises a reactant made by cross-linking the following: an electric charge transporting material which comprises a reactive functional group, a cross-linking resin, and a fluorine surfactant. The toner comprises an inorganic fine particle which defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - 2/100} \quad \text{Equation (1)}$$

where SF-2 denotes a shape factor of the toner.

With this, a good image may be obtained that is free from abnormal images such as those having image density decrease, image blur and the like, even after a long-term repeated operations.

According to a third aspect of the present invention, there is provided a latent electrostatic image carrier for developing a toner, comprising: a support, a photoconductive layer on the support, and a surface protective layer on the support. The surface protective layer comprises a reactant made by cross-linking the following: an electric charge transporting material which comprises a reactive functional group, a cross-linking resin, and a fluorine surfactant. The toner comprises an inorganic fine particle which defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - 2/100} \quad \text{Equation (1)}$$

where SF-2 denotes a shape factor of the toner.

According to a fourth aspect of the present invention, there is provided a toner, comprising: an inorganic fine particle. The toner is used for developing a latent electrostatic image formed on a latent electrostatic image carrier which comprises: a support, a photoconductive layer on the support, and a surface protective layer on the support. The surface protective layer comprises a reactant made by cross-linking the following: an electric charge transporting material which comprises a reactive functional group, a cross-linking resin, and a fluorine surfactant. The inorganic fine particle of the toner defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - 2/100} \quad \text{Equation (1)}$$

where SF-2 denotes a shape factor of the toner.

According to a fifth aspect of the present invention, there is provided a double-component developer, comprising: a magnetic carrier; and a toner which comprises: an inorganic fine particle. The toner is used for developing a latent electrostatic image formed on a latent electrostatic image carrier which comprises: a support, a photoconductive layer on the support, and a surface protective layer on the support. The surface protective layer comprises a reactant made by cross-linking the following: an electric charge transporting material which comprises a reactive functional group, a cross-linking resin, and a fluorine surfactant. The inorganic fine particle of the toner defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - \frac{2}{100}} \quad \text{Equation (1)}$$

where SF-2 denotes a shape factor of the toner.

According to a sixth aspect of the present invention, there is provided a toner container, comprising: a toner loaded in the toner container. The toner which comprises an inorganic fine particle is used for developing a latent electrostatic image formed on a latent electrostatic image carrier which comprises: a support, a photoconductive layer on the support, and a surface protective layer on the support. The surface protective layer comprises a reactant made by cross-linking the following: an electric charge transporting material which comprises a reactive functional group, a cross-linking resin, and a fluorine surfactant. The inorganic fine particle of the toner defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - \frac{2}{100}} \quad \text{Equation (1)}$$

where SF-2 denotes a shape factor of the toner.

According to a seventh aspect of the present invention, there is provided a process cartridge, comprising: a latent electrostatic image carrier; and a developing unit configured to develop, with a toner, a latent electrostatic image formed on the latent electrostatic image carrier, to thereby form a visible image. The latent electrostatic image carrier comprises: a support, a photoconductive layer on the support, and a surface protective layer on the support. The surface protective layer comprises a reactant made by cross-linking the following: an electric charge transporting material which comprises a reactive functional group, a cross-linking resin, and a fluorine surfactant. The toner comprises an inorganic fine particle which defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - \frac{2}{100}} \quad \text{Equation (1)}$$

where SF-2 denotes a shape factor of the toner.

BRIEF DESCRIPTION OF THE DRAWINGS

FIG. 7A shows an example of a roller contact charging apparatus, while

Figure 1:
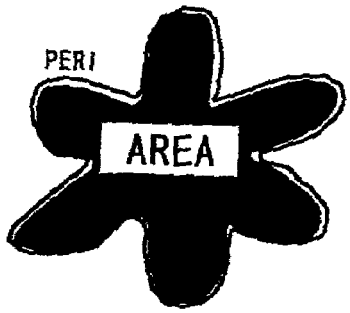
FIG. 1 is a schematic of a toner's shape for explaining a shape factor SF-2.

DESCRIPTION OF THE PREFERRED EMBODIMENTS (Image Forming Apparatus and Image Forming Method)

An image forming apparatus of the present invention has at least a latent electrostatic image carrier, a latent electrostatic image forming unit, a developing unit, a transferring unit, and a fixing unit, moreover, has other units properly selected when necessary, examples thereof including a deelectrifying unit, a cleaning unit, a recycling unit, a controlling unit and the like.

An image forming method of the present invention has at least a latent electrostatic image forming, developing, transferring, and fixing, moreover, has other operations properly selected when necessary, examples thereof including deelectrifying, cleaning, recycling, controlling and the like.

Hereinabove, the image forming apparatus of the present invention is preferred to have a unit for applying an alternating electric field in the developing for developing a latent image on a latent image holding body.

The unit for applying the alternating electric field may apply a vibration bias voltage in which a direct-current voltage is overlapped with an alternating-current voltage when the latent image is developed with a developer, to thereby obtain a highly-precise and fine image which is free from roughness.

The image forming method of the present invention may be preferably carried out with the image forming apparatus of the present invention, the latent electrostatic image forming is carried out by the latent electrostatic image forming method, the developing is carried out by the developing method, the transferring is carried out by the transferring method, the fixing is carried out by the fixing method, and the other operations are carried out by the other methods.

—Latent Electrostatic Image Forming and Latent Electrostatic Image Forming Unit—

The latent electrostatic image forming is for forming a latent electrostatic image on the latent electrostatic image carrier.

Material, shape, structure, scale, and the like of the latent electrostatic image carrier (referred to as "photoconductive insulator" and "photoconductor," as the case may be) are not specifically limited, and therefore may be properly selected from those conventionally known in the art, a preferable example of the shape including a drum.

As long as having the support and having at least the photoconductive layer and the surface protective layer which are located on the support, the photoconductor is not specifically limited. The photoconductive layer may be an electric charge generating layer and an electric charge transporting layer which are sequentially located on the support, moreover, when necessary, an undercoat layer may be interposed between the support and the photoconductive layer.

Examples of the support include those having conductivity of volume resistance $10^{10}\Omega\cdot$cm or less, specifically, those formed by coating film-shaped or cylindrical plastic or paper with metals such as aluminum, nickel, chromium, nichrome, copper, gold, silver, platinum and the like, or with metal oxides such as tin oxide, indium oxide and the like, through vacuum deposition or spattering; those formed by extrusion, drawing and the like of aluminum plate, aluminum alloy plate, nickel plate, stainless plate and the like into a tube; and an endless nickel belt, an endless stainless belt and the like described in JP-A No. 52-36016. Moreover, the supports through the following may also be preferably used: i) forming continuous roughness on the surface of the supports with a cutting tool, ii) liquid honing, iii) super finishing, iv) wet blast or dry blast, and v) roughening treatment by forming anode oxidation film, and the like.

The undercoat layer is preferably be the one made from an inorganic pigment and a thermosetting resin.

Preferable examples of solvent constituting an application solution for the undercoat layer include non-halogen solvents such as methanol, ethanol, isopropanol, acetone, methyl ethyl ketone, cyclohexanone, tetrahydrofuran, dioxane, ethyl cellosolve, ethyl acetate, methyl acetate, cyclohexane, toluene, xylene, ligroin and the like.

The undercoat layers may be added by additives and the like, and have a proper film thickness 0.5 μm to 10 μm.

Dispersing methods of dispersing the application solution for the undercoat layer include fine-particle treatment by a pulverizing unit imparting to a pigment a mechanical energy such as compression, shear, wear-pulverization, friction, elongation, impact, vibration and the like, specific examples thereof including ball mill, vibration mill, disk vibration mill, attritor, sand mill, beads mill, paint shaker, jet mill, ultrasonic wave dispersing method and the like with which the pigment's coarse particles are mechanically shocked under the presence of a dispersing solvent.+

Examples of a coating method of the application solution for undercoat layer include dipping-coating method, spray coating method, beat coating method, nozzle coating method, spinner coating method, ring coating method and the like. Moreover, for providing a second undercoat layer constituted of a cross-link body which is i) a melamine resin and a cross-linked N-alkoxy methylated polyamide or ii) melamine and a cross-linked N-alkoxy methylated polyamide, the above methods may be preferably used.

For bringing about excellent sensitivity and excellent durability, the photoconductive layer is preferred to have lamination of an electric charge generating layer and an electric charge transporting layer.

The electric charge generating layer may be formed in the following manner: dispersing an organic pigment (as an electric charge generating material) in combination with a binder resin in a proper solvent by using a ball mill, an attritor, a sand mill, an ultrasonic wave and the like, applying the resultant on to the support or on to the undercoat layer on the support, and drying the resultant.

The electric charge generating layer may be added by an additive and the like, and have a preferable film thickness 0.01 μm to 5 μm, and more preferably 0.1 μm to 2 μm.

Examples of the organic pigment (as an electric charge generating material) contained in the electric charge generating layer include monoazo pigment, disazo pigment, trisazo pigment, perylene pigment, perinone pigment, quinacridone pigment, quinone condensation polycyclic compound, squaric acid dye, other phthalocyanine pigment, naphthal cyanine pigment, azulenium salt dye and the like. Especially, those having the phthalocyanine are advantageously used. Among them, as a high sensitivity material, titanyl phthalocyanine, especially the titanyl phthalocyanine that has at least a crystal with a maximum diffraction peak of Bragg angle 2θ of 27.2°±0.2° in an X-ray diffraction spectrum relative to Cu-Kα line is especially effective.

More preferably, two or more of the electric charge generating materials having different particle diameters are to be contained in the electric charge generating layer.

Moreover, the electric charge generating material contained in the electric charge generating layer has a proper average particle diameter 0.01 μm to 1.0 μm. In the case that the undercoat layer is located, the average particle diameter of the electric charge generating material is preferred to be less than that of metal oxide contained in the undercoat layer, so as to prevent impregnation of the electric charge transporting material.

Examples of the binder resin constituting the electric charge generating layer include polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinylcarbazole, polyacrylic amide, polyvinyl benzal, polyester, phenoxy resin, vinyl chloride-vinyl acetate copolymer, polyvinyl acetate, polyphenylene oxide, polyamide, polyvinyl pyridine, cellulose resin, casein, polyvinyl alcohol, polyvinyl pyrrolidone, and the like. The above binder resins may be used alone or in combination of two or more.

Among the above, polyvinyl acetal having its typical material polyvinyl butyral is preferably used.

Addition amount of the binder resin is preferably 10 mass parts to 500 mass parts relative to electric charge generating material 100 mass parts, and more preferably 0 mass part to 300 mass parts.

Examples of the solvent constituting the application solution for the electric charge generating layer include methanol, ethanol, isopropanol, acetone, methyl ethyl ketone, cyclohexanone, tetrahydrofuran, dioxane, ethyl cellosolve, ethyl acetate, methyl acetate, dichloromethane, dichloroethane, monochloro benzene, cyclohexane, toluene, cyclobutanone, ligroin and the like. In view of the environmental problem and the like, halogen-free ketone solvent, halogen-free ester solvent, halogen-free ether solvent are preferably used.

Examples of the coating method for the application solution include dipping-coating method, spray coat, beat coat, nozzle coat, spinner coat, ring coat and the like.

Moreover, for increasing contact angle relative to purified water by decreasing surface energy of the electric charge generating layer, addition of a silicone oil and the like is preferable.

The electric charge transporting layer contains at least an electric charge transporting material and a binder resin. Moreover, when necessary, the electric charge transporting layer contains other components such as a plasticizer, a leveling agent, an oxide preventive and the like.

The above structural materials are to be dissolved or dispersed in non-halogen solvent, preferably, in cyclic ethers such as tetrahydrofuran, dioxolane, dioxane and the like, aromatic hydrocarbons such as toluene, xylene and the like, and derivatives thereof. Then, the resultant is to be applied on to the electric charge generating layer, following by drying, to thereby form the electric charge transporting layer.

The electric charge transporting material is, in general, largely categorized into a positive hole transporting material and an electron transporting material.

Examples of the electron transporting material include electron receptivity materials such as chloranil, bromanyl, tetracyano ethylene, tetracyano quinodimethane, 2,4,7-trinitro-9-fluorenone, 2,4,5, 7-tetranitro-9-fluorenone, 2,4,5,7-tetranitro xanthone, 2,4,8-trinitro thioxanthone, 2,6,8-trinitro-4H-indeno [1,2-b]thiophene-4-one, 1,3, 7-trinitro dibenzothiophene-5,5-dioxide, benzoquinone derivative, and the like.

On the other hand, examples of the positive hole transporting material include poly-N-vinylcarbazole and derivatives thereof, poly-γ-carbazolyl ethyl glutamate and derivatives thereof, pyrene-formaldehyde condensate and derivatives thereof, polyvinyl pyrene, polyvinyl phenanthrene, polysilane, oxazole derivative, oxadiazole derivative, imidazole derivative, monoaryl amine derivative, diaryl amine derivative, triaryl amine derivative, stilbene derivative, α-phenylstilbene derivative, benzidine derivative, diaryl methane derivative, triaryl methane derivative, 9-styryl anthracene derivative, pyrazoline derivative, divinylbenzene derivative, hydrazone derivative, indene derivative, butadiene derivative, pyrene derivative, bisstilbene derivative, enamine derivative, and other conventionally known materials.

The above electric charge transporting materials may be used alone or in combination of two more.

Examples of the binder resin constituting the electric charge transporting layer include thermoplastic resins and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyallate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, alkyd resin, and the like. Especially, the polycarbonate is preferably used for its excellence in electric property and wear resistance.

Addition amount of the electric charge transporting material is preferably 20 mass parts to 300 mass parts relative to the binder resin 100 mass parts, and preferably 40 mass parts to 150 mass parts.

The electric charge transporting layer has a preferable film thickness 5 μm to 100 μm.

Moreover, as a material constituting the electric charge transporting layer, a high molecular electric charge transporting material is preferably used that has a function of electric charge transporting material combined with a function of binder resin.

The electric charge transporting layer having the high molecular electric charge transporting material as its structural material is excellent in wear resistance. Improving the wear resistance may decrease an increase of electric field strength applied to the photoconductor in the repeated operations, thereby making the effect of the present invention more remarkable.

The high molecular electric charge transporting material is not specifically limited, and therefore may be selected from those conventionally known. Preferably used are polycarbonates having triaryl amine structure in at least one of main chain and side chain thereof, which structure being expressed by the following structural formula (1) to structural formula (10).

Structural formula (1)

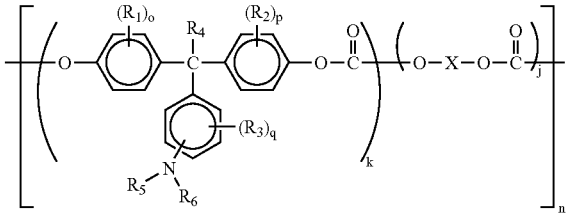

In the structural formula (I), $R_1$, $R_2$, $R_3$ are respectively substituted or unsubstituted alkyl groups or halogen atoms, $R_4$ is a hydrogen atom or a substituted or unsubstituted alkyl group, $R_5$, $R_6$ are substituted or unsubstituted aryl groups, o, p, q are integers in the range of 0 to 4, k, j represent compositional fractions where $0.1 \leqq k \leqq 1$, $0 \leqq j \leqq 0.9$, n represents the number of repeating units and is an integer in the range of 5 to 5,000.

X is an aliphatic divalent group, a cyclic aliphatic divalent group, or the divalent group expressed by the following structural formula (1)-1.

Structural formula (1)-1

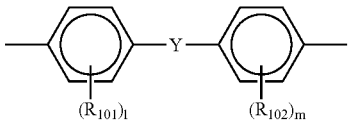

In the structural formula (1)-1, $R_{101}$, $R_{102}$ are respectively substituted or unsubstituted alkyl groups, an aryl group, or a halogen atom, l, m are integers in the range of 0 to 4, Y is a single bond, straight-chain, branched or cyclic alkylene group having 1 to 12 carbon atoms, —O—, —S—, —SO—, —$SO_2$—, —CO—, —CO—O—Z—O—CO—(Z is an aliphatic divalent group), or the one expressed by the following structural formula (1)-2:

Structural formula (1)-2

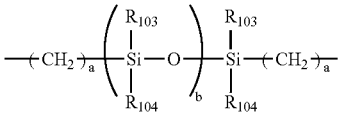

In the structural formula (1)-2, a is an integer in the range of 1 to 20, b is an integer in the range of 1 to 2,000, $R_{103}$, $R_{104}$ are substituted or unsubstituted alkyl groups or aryl groups. $R_{101}$, $R_{102}$, $R_{103}$, $R_{104}$ may be respectively identical or different.

Structural formula (2)

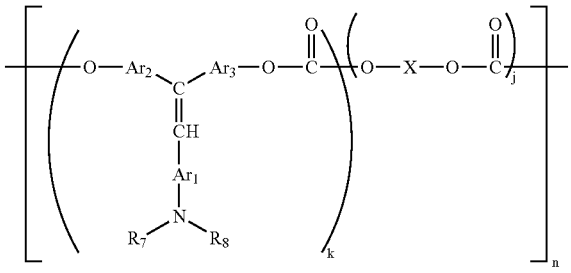

In the structural formula (2), $R_7$, $R_8$ are substituted or unsubstituted aryl groups, $Ar_1$, $Ar_2$, $Ar_3$ are arylene groups which may be identical or different, X, k, j and n are the same as those in structural formula (1).

Structural formula (3)

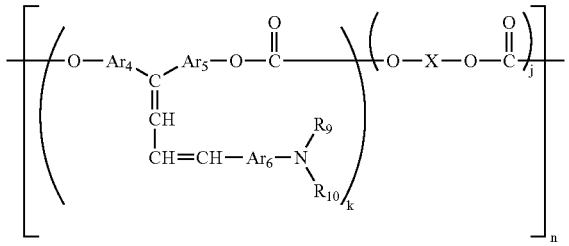

In the structural formula (3), $R_9$, $R_{10}$ are substituted or unsubstituted aryl groups, $Ar_4$, $Ar_5$, $Ar_6$ are arylene groups which may be identical or different, X, k, j and n are the same as those in structural formula (1).

Structural formula (4)

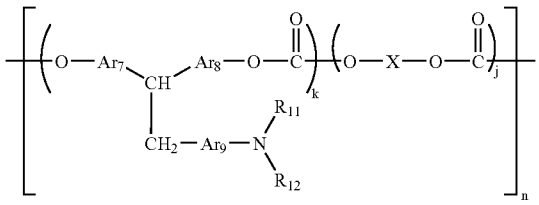

In the structural formula (4), $R_{11}$, $R_{12}$ are substituted or unsubstituted aryl groups, $Ar_7$, $Ar_8$, $Ar_9$ are arylene groups which may be identical or different, p is an integer in the range of 1 to 5, X, k, j and n are the same as those in the structural formula (1).

Structural formula (5)

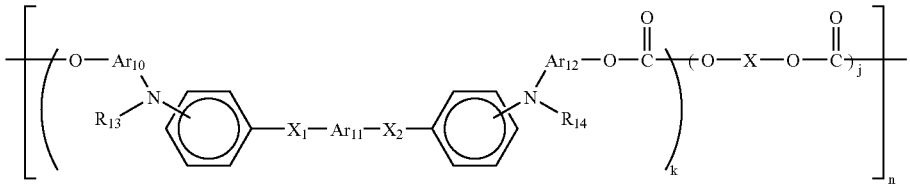

In the structural formula (5), $R_{13}$, $R_{14}$ are substituted or unsubstituted aryl groups, $Ar_{10}$, $Ar_{11}$, $Ar_{12}$ are arylene groups which may be identical or different, $X_1$, $X_2$ are substituted or unsubstituted ethylene groups, or substituted or unsubstituted vinylene groups. X, k, j and n are the same as those in the structural formula (1).

Structural formula (6)

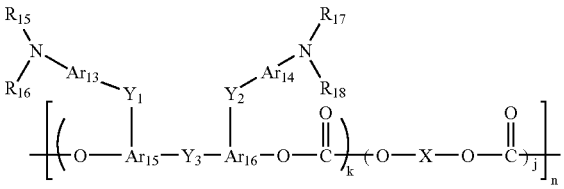

In the structural formula (6), $R_{15}$, $R_{16}$, $R_{17}$, $R_{18}$ are substituted or unsubstituted aryl groups, $Ar_1$, $Ar_2$, $Ar_3$ are arylene groups which may be identical or different, $Y_1$, $Y_2$, $Y_3$ are single bond, substituted or unsubstituted alkylene groups, substituted or unsubstituted cycloalkylene groups, substituted or unsubstituted alkylene ether groups, oxygen atoms, sulfur atoms or vinylene groups. X, k, j and n are the same as those in the structural formula (1).

Structural formula (7)

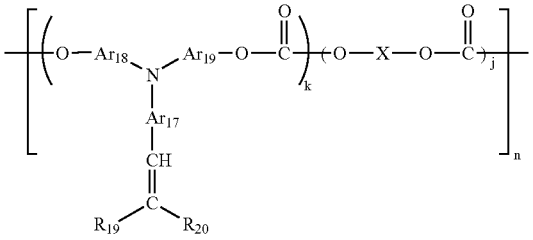

In the structural formula (7), $R_{19}$, $R_{20}$ are hydrogen atoms, or substituted or unsubstituted aryl groups, and $R_{11}$, $R_{20}$ may form a ring. $Ar_{17}$, $A_{18}$, $A_{19}$ are arylene groups which may be identical or different. X, k, j and n are the same as those in the structural formula (1).

In the structural formula (8), $R_{21}$ is a substituted or unsubstituted aryl group, $Ar_{20}$, $Ar_{21}$, $Ar_{22}$, $Ar_{23}$ are arylene groups which may be identical or different, X, k, j and n are the same as those in the structural formula (1).

Structural formula (9)

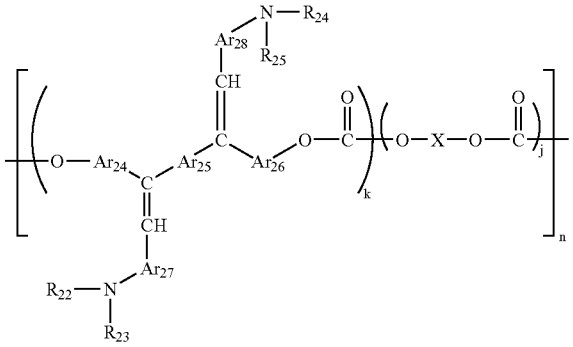

In the structural formula (9), $R_{22}$, $R_{23}$, $R_{24}$, $R_{25}$ are substituted or unsubstituted aryl groups, $Ar_{24}$, $Ar_{25}$, $Ar_{26}$, $Ar_{27}$, $Ar_{28}$ are arylene groups which may be identical or different. X, k, j and n are the same as those in the structural formula (1).

Structural formula (10)

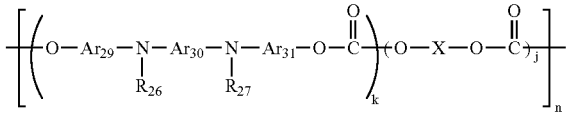

In the structural formula (10), $R_{26}$, $R_{27}$ are substituted or unsubstituted aryl groups, $Ar_{29}$, $Ar_{30}$, $Ar_{31}$ are arylene groups which may be identical or different. X, k, j and n are the same as those in the structural formula (1).

Moreover, as a high molecular electric charge transporting material used for the electric charge transporting layer, the following polymer is to be contained, other than the above high molecular electric charge transporting material: A poly- Structural formula (8)

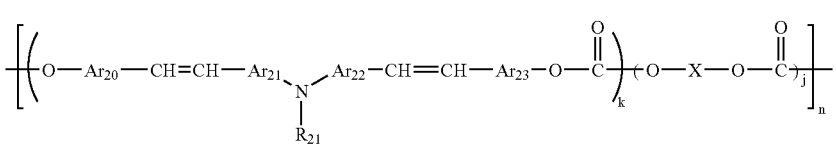

mer which is in a state of an electron donating group-contained monomer or an electron donating group-contained oligomer in the film forming of the electric charge transporting layer. Then, with a curing reaction or a cross-linking reaction after the film forming, the polymer finally has two-dimensional or three dimensional cross-link structure.

Moreover, examples of polymers having other electron donating groups include a copolymer of known monomer, a block polymer, a graft polymer, a star polymer, and the like. Moreover, the above examples include the electron donating group-contained cross-link polymers described in JP-A No. 3-109406, JP-A No. 2000-206723, and JP-A No. 2001-34001.

The electric charge transporting layer may contain a plasticizer or a leveling agent.

Usable as the plasticizer include those generally used for plasticizer of resin, such as dibutyl phthalate, dioctyl phthalate and the like, with its proper consumed quantity being 0% by mass to 30% by mass relative to the binder resin.

Moreover, usable as the leveling agent include silicone oils such as dimethyl silicone oil, methyl phenyl silicone oil and the like; and polymer or oligomer having perfluoroalkyl group in the side chain thereof, with its consumed quantity being 0% by mass to 1% by mass relative to the binder resin.

The surface protective layer contains at least a reactant made by cross-linking the following: an electric charge transporting material which contains a reactive functional group, a cross-link resin, and a fluorine surfactant.

Herein, the surface protective layer, as the case may be, constitutes a part of the electric charge transporting layer (located on a surface side of the photoconductor) responsible for the electric charge transportability and the low surface energy durability on the photoconductor surface.

The fluorine resin blended-surface protective layer shows as high electric charge mobility as that of the conventional electric charge transporting layer.

Moreover, the photoconductor's top surface protective layer is used as a surface layer where the electric charge transporting layer of the laminated photoconductor are separated into two or more layers in terms of function. In other words, the above top surface protective layer is used for lamination with the above electric charge transporting layer, not being used alone, and thereby may be distinguished from the single layer of the electric charge transporting layer.

Examples of the electric charge transporting material which contains the reactive functional group includes hydroxyl group (—OH), isocyanate group (—NCO), epoxy group (—CH—$CH_2$—O—), alkoxy silane (—Si—OR) and the like.

The electric charge transporting material may be those in the above description of the electric charge transporting layer. The electric charge transporting material is, however, in need of containing a reactant with the cross-linking resin.

Examples of the electric charge transporting material which contains the reactive functional group includes the following:

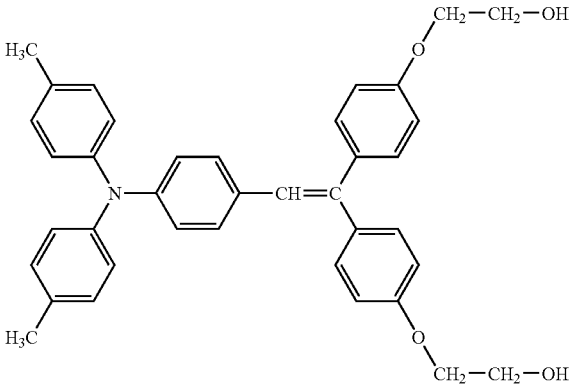

D1600

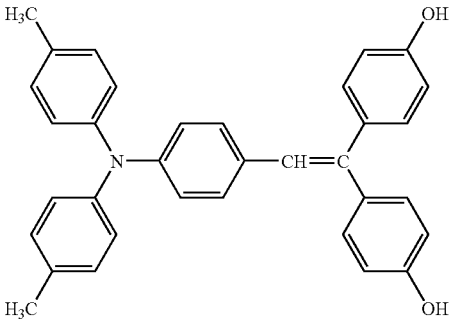

D1410

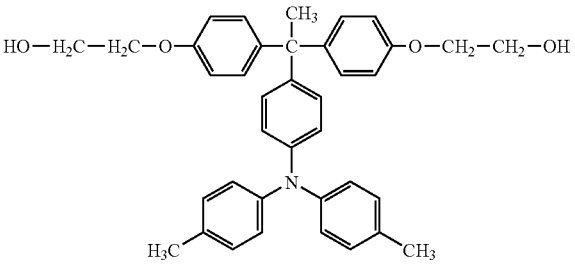

HEAP

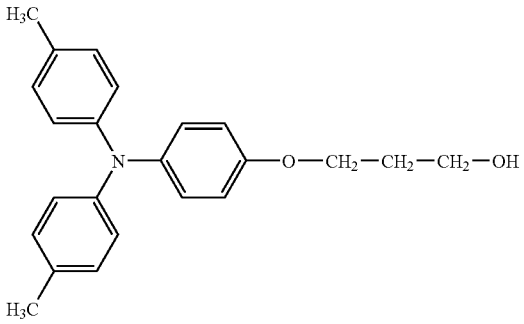

HPTPA

-continued

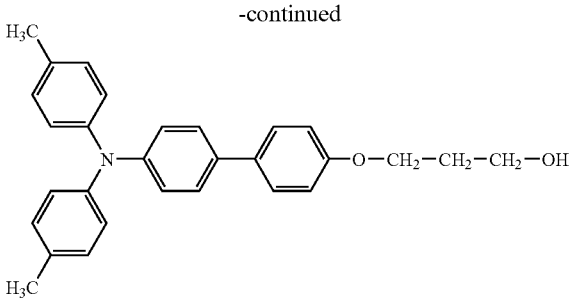

HPBiPh

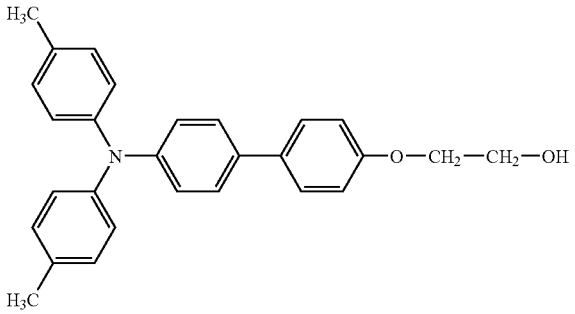

HEBiPh

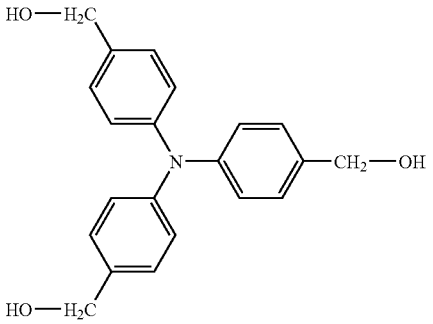

THMTPA

Of the above examples, the compound having a larger molecular weight (equivalent) per functional group is preferable, since such material is capable of increasing donor blending amount to the cured film. Specifically, molecular weight of 200 to 400 is preferable.

Addition of the electric charge transporting material is 20 mass parts to 300 mass parts relative to the resin component 100 mass parts, and more preferably 40 mass parts to 150 mass parts.

When the electric charge transporting material for the electric charge transporting layer and the electric charge transporting material contained in the top surface protective layer of the photoconductor are different from each other, an ionizing potential difference between the electric charge transporting materials of the above layers is preferably as small as possible, specifically, 0.10 eV or less.

Likewise, when two or more electric charge transporting materials are used for the top surface protective layer of the photoconductor, preferably, the material is to be selected such that the ionizing potential difference of these is 0.10 eV or less.

Moreover, when a high speed response is required, it is advantageous to increase the electric charge mobility of the top surface protective layer of the photoconductor, moreover preferably, to sufficiently increase the electric charge mobility of the low electric field zone. Specific conditions thereof are preferably those described hereinabove.

As long as having the cross-linking property, the cross-linking resin is not specifically limited, and therefore can be selected according to the object from those conventionally known, examples thereof including polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyallate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, alkyd resin, and the like.

Fluorine surfactant to be contained in the surface protective layer may be those conventionally known.

(1) As a copolymer containing (meth)acrylate having fluoroalkyl group described in paragraph [0017] of JP-A No. 07-068398, JP-A No. 60-221410 and JP-A No. 60-228588, for example, describe a block copolymer made from fluorine-noncontaining vinyl monomer and fluorine-contained vinyl monomer. Hereinabove, the (meth)acrylate denotes at least one of acrylate and methacrylate.

(2) As a fluorine graft polymer, JP-A No. 60-187921, for example, describes a comb-type graft polymer which is a copolymer of a i) methacrylate macro monomer having polymethyl methacrylate in a side chain thereof and ii) (meth) acrylate having fluoroalkyl group. Hereinabove, the (meth) acrylate denotes at least one of acrylate and methacrylate.

The above fluorine resins are commercially available as coating additive, examples of fluorine-contained random copolymer including resin surface modifier SC-101 and SC-105 commercially available from Asahi Glass.

Examples of the fluorine-contained block copolymer include a block copolymer made from a fluorine alkyl group-contained polymer segment and an acrylic polymer segment, specifically, Modiper F series (for example, F100, F110, F200, F210, and F2020) are commercially available from NOF CORPORATION.

As a fluorine graft polymer, Aron GF-150, GF-300, and RESEDA GF-2000 made by Toagosei Co., Ltd. are commercially available and are useful.

Addition of the fluorine surfactant is 5% by weight to 70% by weight, relative to an entire solid content of the protective layer, for keeping low μ (friction resistance).

Moreover, the surface protective layer, when necessary, may be added by proper low molecular compounds (such as oxide preventive, plasticizer, lubricant, ultraviolet ray absorbing agent and the like), and leveling agent. The above materials may be used alone or in combination of two or more.

The consumed quantity of the low molecular compound is preferably 0.1 mass part to 50 mass parts relative to resin component 100 mass parts, and more preferably 0.1 mass part to 20 mass parts. Moreover, the consumed quantity of the leveling agent is preferably 0.001 mass part to 5 mass parts relative to resin component 100 mass parts.

Examples of the dispersing solvent useable for the surface protective layer include ketones, ethers, aromatic compounds, halogen compounds, esters and the like. Among the above, having lower environmental load than chlorobenzene, dichloromethane, toluene and xylene, the methyl ethyl ketone, tetrahydrofuran, and cyclohexanone are preferable.

Moreover, examples of methods for forming the surface protective layer include dipping method, spray coating method, ring coating method, roll coater method, gravure coating method, nozzle coating method, screen printing method, and the like. Among the above, the spray coating method and the ring coating method are preferable, in view of securing quality stability in production.

The surface protective layer has a preferable film thickness 1 μm or more, and more preferably 2 μm or more.

Increasing film thickness of the surface protective layer of the photoconductor may store remaining potentials in the surface protective layer to thereby form a spaced electric charge in the surface protective layer, thus decreasing the image density of the output image or outputting abnormal images such as positive remaining image and the like.

Therefore, setting of the film thickness is to such an extent that forming of the spaced electric charge in the surface protective layer of the photoconductor does not substantially influence the output image.

Contrary to the above, for example, the following guideline may set the film thickness of the surface protective layer of the photoconductor.

Specifically described as below: At first, a period from an exposing (of an electrophotography process using the photoconductor) to a developing is defined as an exposing-developing time denoted by "Ted" for convenience sake. Carrying out printing with an absolute value more than 0.7 V/msec may so often cause the abnormal image, which absolute value is a change amount (dVL/dt) of the exposed part potential (VL) of the electrophotographic photoconductor relative to time change near the Ted.

Therefore, the film thickness of the surface protective layer of the photoconductor is to be so set that the above change amount is less than 0.7 V/msec.

For satisfying the above, the protective layer has a specific film thickness 2 μm to 10 μm.

Forming of the latent electrostatic image may be carried out, for example, by uniformly charging the surface of the latent electrostatic image carrier, followed by exposing imagewise, by using the latent electrostatic image forming unit.

The latent electrostatic image forming unit is, for example, provided with at least a charging device for uniformly charging the surface of the latent electrostatic image carrier, and an exposing device for exposing imagewise the surface of the latent electrostatic image carrier.

The charging may be carried out, for example, by applying a voltage to the surface of the latent electrostatic image carrier with the charging device.

The charging device is not specifically limited and therefore may be properly selected according to the object, examples thereof including: i) a conventionally known contact charging device provided with conductive or semiconductive roll, brush, film, rubber blade and the like; ii) a non-contact charging device using corona discharge such as corotron, scorotron and the like; and the like.

The exposing may be carried out, for example, by exposing imagewise the surface of the latent electrostatic image carrier with the exposing device.

As long as being capable of carrying out the imagewise exposing on the surface of the latent electrostatic image carrier charged by the charging device, the exposing device is not specifically limited and therefore may be properly selected according to the object, examples thereof including various exposing devices such as copy optical system, rod lens array system, laser optical system, liquid crystal shutter optical system, and the like.

Herein, of the present invention, an optical backface method may be adopted which carries out the imagewise exposing from a backface side of the latent electrostatic image carrier.

—Developing Operation and Developing Unit—

In the developing, the latent electrostatic image is developed using the toner and the developer of the present invention to form a visible image.

The visible image may be formed for example by developing the latent electrostatic image using the toner and the developer of the present invention, which may be performed by means of the developing unit.

A double-component developer having the toner and the carrier is to be used in combination with the photoconductor, with the toner added by an inorganic fine particle for removing deposit.

$$\text{Effective inorganic particle amount}(\%) = \frac{\text{Inorganic particle amount}(\%)}{SF - \frac{2}{100}} \qquad \text{Equation (1)}$$

In the above equation (1), SF-2 denotes toner's shape factor.

The inorganic fine particle having an effective addition amount in a range of 0.8% by mass to 3.0% by mass which is calculated based on the equation (1) may remove the deposit properly adhered on to the surface of the photoconductor in the repeated operations. In this case, the photoconductor which is in itself unlikely to be peeled may bring about highly-reliable image quality for a long term.

The follow was verified: Merely adding the inorganic fine particle to the toner for obtaining the effect of polishing the deposit on the organic photoconductor is not sufficient. Shape of the toner matrix before the addition is dominant. Even when the addition amounts are the same, the toner matrix shaped into a sphere and the toner matrix having many depressions-protrusions (indefinite) have a great difference from each other in removal amount of the filming product.

More specifically, the inorganic fine particle may properly function as a polishing agent by decreasing the addition amount of the inorganic fine particle for more spherical toner while by increasing the addition amount of the inorganic fine particle for more indefinite-shape toner, such that the effective inorganic fine particle amount may be adjusted within the specified range.

When the inorganic fine particle amount is less than 0.8% by mass, the deposit increased with elapsed time cannot be removed and thereby stored, to thereby decrease the image density and cause the image blur. When the inorganic fine particle amount is more than 3.0% by mass, the inorganic fine particle in the developing unit may get free, and thereby the thus freed (liberated) inorganic fine particle itself may cause filming to the photoconductor.

FIG. 1 is a schematic of the toner's shape for explaining the shape factor SF-2.

The shape factor SF-2 shows a ratio of depression-protrusion of the toner shape, and is expressed by the following equation (2). A peripheral length PERI is to be measured which is a diagram formed by projecting the toner to a two-dimensional flat face. The shape factor SF-2 signifies a ratio of a circle area formed by the peripheral length PERI relative to an "AREA" of the diagram.

With this, the SF-2 100 denotes a complete sphere having no depression-protrusion on the toner surface, while larger SF-2 denotes more remarkable depression-protrusion on the toner surface.

$$SF-2=\frac{(PERI)^2}{\text{AREA}}\times\frac{\pi}{4}\times 100 \qquad \text{Equation (2)}$$

The shape factor SF-2 is preferably in a range of 110 to 140. The SF-2 less than 110 may smoothen the toner surface thus rolling the inorganic fine particle, to thereby cause a filming attributable to the freed (liberated) inorganic fine particle. Moreover, with an additive aggregated by the freed (liberated) inorganic fine particle, the toner may not have a proper friction charging with the carrier, thus increasing abnormal images such as background shading. On the other hand, the SF-2 more than 140 may increase the toner's protrusions which are likely to transfer to the photoconductor, accelerating the filming.

Moreover, as an index of denoting roundness ratio of the toner shape, a shape factor SF-1 is expressed by the following equation (3).

Figure 3:
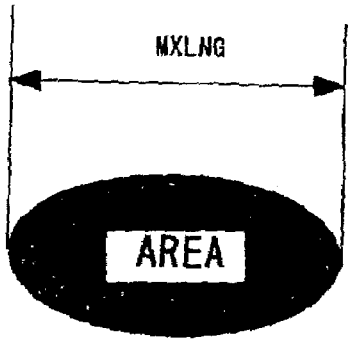
FIG. 3 is a schematic of the toner's shape for explaining a shape factor SF-1.

FIG. 3 is a schematic of the toner's shape for explaining the shape factor SF-1.

The shape factor SF-1 signifies a ratio of an area having its maximum length MXLNG as its diameter relative to the "AREA" of the diagram.

$$SF-1=\frac{(MXLNG)^2}{\text{AREA}}\times\frac{\pi}{4}\times 100 \qquad \text{Equation (3)}$$

The shape factor SF-1 is preferably in a range of 140 to 175. The shape factor SF-1 100 denotes a complete sphere of the toner shape. The larger the SF-1 is, the more indefinite the toner shape is.

The shape factor SF-1 less than 140, which is close to the sphere, may allow the inorganic fine particle to be freed (liberated) from the toner, causing the filming. The shape factor SF-1 more than 175 may degrade the toner fluidity, thus decreasing the image density.

For the toner used in the present invention, the inorganic fine particle preferably has its addition amount in a range of 1.0% by mass to 4.0% by mass relative to the toner. As described above, of the present invention, adding comparatively a large amount of inorganic fine particles may allow the fine particle to properly act on the photoconductor as polishing material, which is effective for preventing the filming.

The addition amount less than 1.0% by mass may not sufficiently perform the wear resistance, while more than 5.0% by mass may decrease the image quality due to the inorganic fine particle, or may cause filming and the like attributable to the inorganic fine particle itself, which are not preferable.

The inorganic fine particle is not specifically limited, and therefore may be properly selected according to the object, examples thereof including silica, alumina, titanium oxide, barium titanate, magnesium titanate, calcium titanate, strontium titanate, iron oxide, copper oxide, zinc oxide, tin oxide, quartz sand, clay, mica, silicic pyroclastic rock, diatomite, chromium oxide, cerium oxide, red iron oxide, antimony trioxide, magnesium oxide, zirconium oxide, barium sulfate, barium carbonate, calcium carbonate, silicon carbide, silicon nitride, and the like.

Among the above inorganic fine particles, use of silica, titanium oxide and alumina may bring about a toner having excellent properties such as proper wear resistance and charge stability, which is especially preferable.

The inorganic fine particle is preferably subjected to a hydrophobicity treatment, for obtaining high quality image which is excellent in environmental stability and has small image defect such as "character dropout" and the like. Especially, a hydrophobic inorganic fine particle which is treated with at least one of silicone oil and hexamethyl disilazane is effective.

The hydrophobicity treating agent is not specifically limited, and therefore may be properly selected according to the object, examples thereof including silicone oils such as dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic, methacryl-modified silicone oil, a methyl styrene-modified silicone oil, and the like; silane coupling agent; silylating agent; fluorine alkyl group-contained silane coupling agent; organic titanate coupling agent; aluminum coupling agent; and the like.

Preferably, an average diameter of a primary particle of the inorganic fine particle is 10 nm to 100 nm, and more preferably 10 nm to 70 nm. The inorganic fine particle having the primary particle diameter less than 10 nm may aggregate the additives, causing the filming attributable to freeing (liberation). Moreover, with an elapsed time usage, the additive becomes likely to embed to the toner, deteriorating chargeability of the toner and causing background shading. The inorganic fine particle having the primary particle diameter more than 100 nm may relatively decrease the surface, degrading adhering property to the toner to thereby cause freeing (liberation).

Moreover, the carrier constituting the developer of the present invention, preferably, has an amount of carrier particle (diameter less than 22 μm) in a range of 0% to 15%, and more preferably 0% to 6%, and preferably has an amount of carrier particle (diameter more than 88 μm) in a range of 0% to 5%, and especially preferably 0% to 3%.

The amount of the carrier having the carrier particle (less than 22 μm) more than 15% may increase fluidity of the developer over a proper range, damaging smooth friction chargeability to thereby cause background shading, while having the carrier particle (more than 88 μm) more than 5% make cause coarse magnetic brushes which are nonuniform, decreasing the fine line reproducibility to thereby fail to obtain high quality image.

The developing unit may be properly selected from those known in the art, provided that it develop an image for example using the toner and the developer of the present invention. For example, such a member is preferable as contains a toner or developer and comprises a developing device which may supply the developer with contact or without contact to the latent electrostatic image. The developing unit is preferred to be provided with the toner container of the present invention.

The developing device may be of dry type or wet type, and may be a monochrome developing or multi-color developing device. For example, such a member is preferable as comprises a stirrer that charges the toner and the developer by friction stirring, and a rotatable magnet roller.

In the developing device, for example, the toner and the carrier are mixed and stirred; the toner is thereby charged by friction and sustained in a condition of standing rice ears, and forms a magnetic brush on the surface of the rotating magnet roller. Since the magnet roller is arranged near the photoconductor, part of the toner in the magnetic brush formed on the surface of this magnet roller moves to the surface of the photoconductor due to the force of electrical attraction. As a result, this toner develops a latent electrostatic image, and a visible toner image is formed on the surface of the photoconductor.

The developer housed in the developing device is the developer containing the toner of the present invention; the developer may be single-component or double-component developer.

Moreover, when the following magnetic carrier is used for the developing method of the present invention:

based on a main magnetic pole center the magnetic carrier has the magnetic flux density 50 mT or more of the developer bearer's surface, and has the weight average particle diameter 30 μm to 60 μm, making the saturated magnetization in a range of 50 emu/g to 120 emu/g relative to an applied magnetic field 1,000 oersted may make the magnetic brush harder than the conventional one, thereby increasing the effect of polishing the photoconductor surface.

Hardness of the magnetic brush may be determined by magnetic force of the development's main magnetic pole and the carrier's saturated magnetization. The hardness of the magnetic brush causing the magnetic force 70 (T) of the development main magnetic pole is preferable.

Moreover, combining the conditions with the photoconductor of the present invention allows the photoconductor itself to continuously keep its original electric property for a long time, without being carved so much. In other words, polishing only the filming product which is deposited with an elapsed time has been accomplished.

As described above, when the carrier having the weight average particle diameter 30 μm to 60 μm is used, making the magnetic flux density (of the developer bearer's surface, based on the development main magnetic pole center) 50 mT or more may cause the development main magnetic pole to have magnetic force 70 (T), thereby forming a magnetic brush having preferable hardness.

Herein, the magnetic flux density less than 50 mT is unlikely to form the magnetic brush having sufficient solidity, varying height of the magnetic brush's rice ear, failing to carry out a uniform development.

It is preferable that the magnetic flux density of the developer bearer's surface (based on the development main magnetic pole center) has a practical upper limit about 150 mT.

Moreover, the saturated magnetization of the magnetic carrier less than 50 emu/g may fail to form the magnetic brush having a proper hardness, fail to perform the polishing effect on the filming, in addition, fail to hold the carrier to the developer bearer to thereby cause carrier adhesion, forming a white-dropout image (abnormal image).

On the other hand, the saturated magnetization of the magnetic carrier more than 120 emu/g may too harden the magnetic brush, causing a tightened state, resulting in deteriorated reproduction of the gradation and middle tone.

Of the present invention, the magnetic property of the carrier may be measured with a measuring apparatus BHU-60 magnetization measuring apparatus (made by Riken Measurement), in the following manner.

A measurement sample having a scaled weight about 1.0 g is to be loaded in a cell having an internal diameter 7 mmϕ and height 10 mm, to be set in the apparatus.

Then, a magnetic field is to be gradually applied until a maximum 3,000 oersted is obtained, followed by decreasing of the applied magnetic field, to thereby finally obtain the sample's hysteresis curve on the recording paper. With the above, the saturated magnetization, the remaining magnetization, and the magnetic holding force may be obtained.

Moreover, for measuring the magnetic flux density, Gauss meter (HGM-8300) made by ADS, A1 axial probe made by ADS and the like are to be used.

Figure 2:
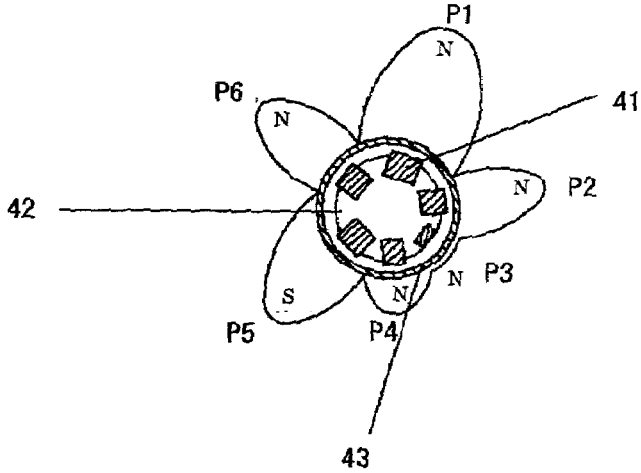
FIG. 2 is a schematic showing a distribution of magnetic flux density of a developer bearer constituting an image forming apparatus, according to a first embodiment of the present invention.

FIG. 2 is a schematic showing a distribution of magnetic flux density of the developer bearer constituting the image forming apparatus, according to a first embodiment of the present invention.

A developer bearer (42) comprises a stationary magnet (41) and a developing sleeve (43) which is rotatable around the stationary magnet (41).

Those magnetized N-pole include a developing magnet (P1), a magnet (P4) for lifting the developer on to the developing sleeve (43), a magnet (P6) for conveying the thus lifted developer to a developing zone, and a magnetic pole (P2) and a magnetic pole (P3) for conveying the developer in the zone after the developing. A magnet (P5) for conveying the thus lifted developer is magnetized S-pole. Of the present invention, (P1) denotes the main magnetic pole.

—Transferring Operation and Transferring Unit—

In the transferring, the visible image is transferred to a recording medium. In a preferred aspect, the visible image is transferred to the intermediate transferring body as the primary transfer, then the visible image is transferred on the recording member as the secondary transfer. More preferably, using a toner of two or more colors and still more preferably using a full color toner, the visible image is transferred to the intermediate transferring body to form a complex-transfer image as the primary transferring, and the complex-transfer image is transferred to the recording medium as the secondary transferring.

The transfer may be achieved, for example, by charging the photoconductor using a transfer-charging device, which may be performed by the transferring unit. In a preferred aspect, the transferring unit comprises a primary transferring unit that transfers the visible image to the intermediate transferring body to form a complex-transfer image, and a secondary transferring unit that transfers the complex-transfer image to the recording medium.

The intermediate transferring body may be properly selected from transferring bodies known in the art, for example, a transferring belt may be exemplified.

The transferring unit (the primary transferring unit and the second transferring unit) preferably comprises a transferring device that conducts peeling-charging of the visible image formed on photoconductor to the side of recording medium. The transferring unit may be one or more.

Examples of the transferring device include a corona transferring device based on corona discharge, transfer belt, transfer roller, pressure transfer roller, adhesion transferring device and the like.

The recording medium is not specifically limited, and may be selected according to the object from the conventionally known recording mediums (recording paper).

In the fixing, the visible image transferred to the recording medium is fixed by means of a fixing device. The fixing may be carried out with respect to the individual toners of respective colors transferred to the recording medium, or may be carried out in one operation after the toners of entire colors have been laminated.

The fixing apparatus may be properly selected according to the object from heat-pressure units known in the art. Examples of the heat-pressure units include a combination of heat roller and pressure roller, and a combination of heat roller, pressure roller and endless belt.

The heating temperature in the heat-pressure unit is typically 80° C. to 200° C.

Also, of the present invention, an optical fixing unit known in the art may be used in addition to or instead of the above fixing operation and the above fixing unit, according to the object.

In the deelectrifying, a deelectrifying bias is applied to the photoconductor to conduct the deelectrifying, which may be performed by a deelectrifying unit.

The deelectrifying unit may be properly selected from those known in the art provided that a deelectrifying bias be applied to the photoconductor; for example, a deelectrifying lamp is preferable.

In the cleaning, the electrophotographic toner remaining on the latent electrostatic photoconductor is removed. The cleaning may be performed by means of a cleaning unit.

The cleaning unit may be properly selected from cleaning units known in the art, provided that the latent electrophotographic toner remaining on the photoconductor be removed; examples thereof include a magnetic brush cleaner, electrostatic brush cleaner, magnetic roller cleaner, blade cleaner, brush cleaner, web cleaner and the like.

In the recycling, the electrophotographic toner removed by the cleaning is recycled to the developing unit, and may be performed by a recycling unit.

The recycling unit may be properly selected from transport units and the like known in the art.

In the controlling, the respective operations are controlled, and may be properly implemented by a controlling unit.

The controlling unit may be properly selected according to the object provided that the respective operations be controlled; examples thereof include a device such as a sequencer and a computer.

Hereinafter described is the electrophotographic image forming apparatus provided with the developing apparatus of the present invention.

Figure 4:
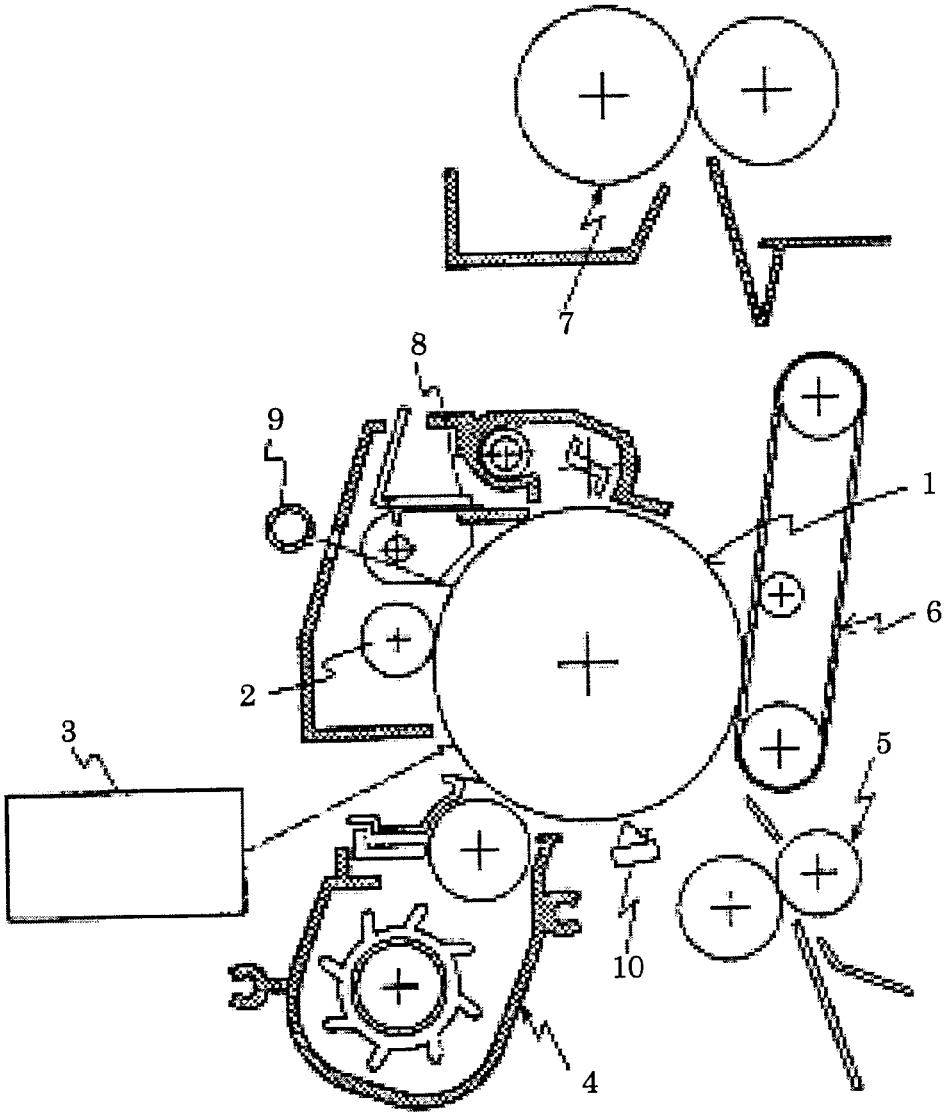
FIG. 4 is a schematic cross sectional view of an example of the image forming apparatus of the present invention.

FIG. 4 is schematic cross sectional view of an example of the image forming apparatus of the present invention.

Around the photoconductor drum (1) which is the image carrier, the following members are provided in such a manner as to be disposed close to or in contact with the photoconductor drum (1): a charging unit (2) for charging a uniform electric charge on to the photoconductor drum (1), an exposing unit (3) for forming the latent electrostatic image on the photoconductor drum (1), a developing unit (4) for visualizing the latent electrostatic image to thereby form a toner image, a belt-shaped transferring unit (6) for transferring the toner image to transfer paper, a cleaning unit (8) for removing the toner remaining on the photoconductor drum (1), a deelectrifying unit (9) for deelectrifying the electric charge remaining on the photoconductor drum (1), a light sensor (10) for controlling the charge roller applied-voltage and the development toner density. Moreover, to the developing unit (4), the toner is supplied from a toner supplying unit (not shown in FIG. 4) by way of a toner supplying opening.

For forming the image, the image forming apparatus may be operated in the following manner.

The photoconductor (1) rotates counterclockwise. The photoconductor (1) is to be deelectrified with a light of a deelectrifying lamp of the deelectrifying unit (9), averaging surface potential to 0 V to −150 V which is a basic potential.

Then, the photoconductor (1) is to be charged by the roller-shaped charging unit (2), causing the surface potential about −1,000 V.

Then, the exposing unit (3) exposes the image, causing the surface potential 0 V to −200 V in a part (image part) where the light is irradiated.

The developing unit (4) adheres the toner on the sleeve to the image part, turning the photoconductor (1) formed with the toner image. Then, by means of the belt-shaped transferring unit (6), the transfer paper is to be conveyed from a paper feed part (5) at such a timing that the paper end and the image end may coincide with each other, to thereby transfer to the transfer paper the toner image on the surface of the photoconductor (1).

Thereafter, the transfer paper is conveyed to the fixing section (7). Then, the toner is fused to the transfer paper with the heat and pressure, to be ejected as copy.

The remaining toner on the photoconductor (1) may be cleaned away with the cleaning blade (8), recycling the toner by way of the toner supplying opening (not shown).

Thereafter, the light of the deelectrifying unit (9) may deelectrify the remaining electric charge, returning the photoconductor (1) to the initial state thereof free of the toner, to be followed by the next image-forming operation.

Of the present invention, setting up a cleaning operation where the cleaning blade (8) which is a resilient rubber blade abutting on the photoconductor (1) in the counter direction of the photoconductor (1)'s rotation may effectively remove the paper powder and the filming, which is preferable.

In this case, the resilient rubber blade is preferred to be so constituted that a support member thereof has a free end, but not limit thereto.

The resilient rubber blade has hardness of JIS A60° to A70°, repulsion resilience 30% to 70%, Young's modulus of 30 kgf/cm$^2$ to 60 kgf/cm$^2$, thickness 1.5 mm to 3.0 mm, free length 7 mm to 12 mm, pressure to photoconductor 15 g/cm or less, and resilient rubber blade's abutting angle relative to the photoconductor (1) in a range of 5° to 50°, and preferably 10° to 30°.

The image forming apparatus of the present invention applies an alternating electric field when developing the latent electrostatic image on the photoconductor.

Figure 5:
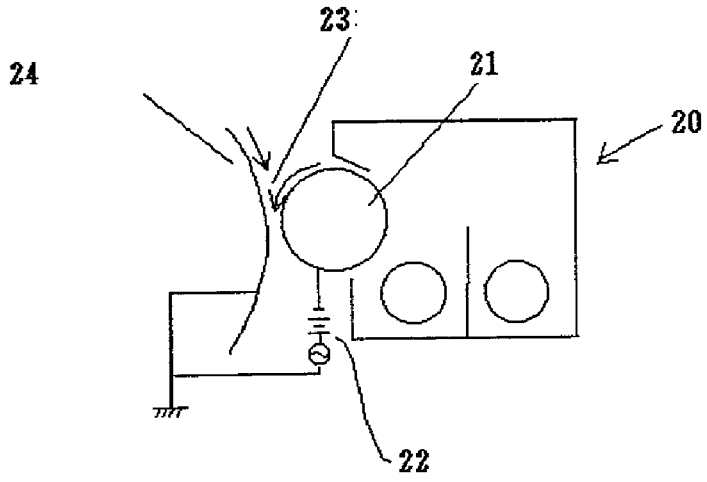
FIG. 5 shows an example of a developing device of the image forming apparatus of the present invention.
Figure 6:
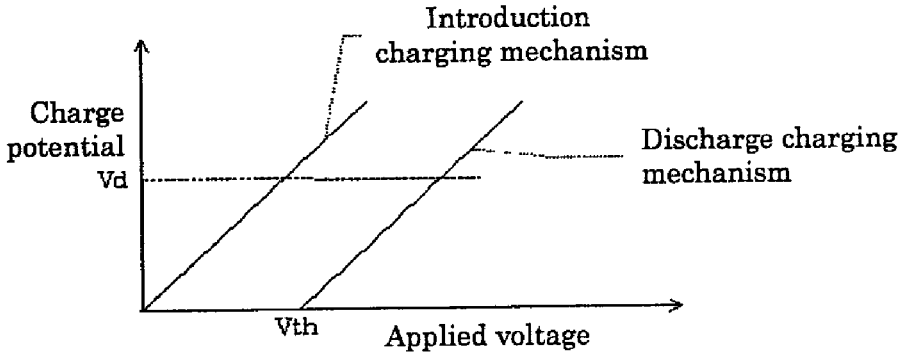
FIG. 6 shows charging property of contact charging.

With a developing device (20) according to the embodiment in FIG. 5, in the developing, a power source (22) applies to a developing sleeve (21) a vibration bias voltage which is a developing bias caused by overlapping a direct-current voltage with an alternating-current voltage. A back part potential and an image part potential are positioned between a maximum value and a minimum value of the above vibration bias potential, to thereby form on a developing section (23) the alternating electric field alternately changing the direction. In the alternating electric field, the developer's toner and carrier may vibrate violently, thereby the toner may jet (fly) to the photoconductor drum (24) against an electrostatic biding force to the developing sleeve (21) and the carrier. Then, the toner may be adhered in such a manner as to correspond to a latent image of the photoconductor drum.

The vibration bias voltage has, preferably, the difference (peak-peak voltage) between the maximum value thereof and the minimum value thereof in a range of 0.5 kV to 5 kV and a frequency 1 kHz to 10 kHz. The vibration bias voltage may have a waveform such as rectangular wave, sine wave, triangular wave and the like. As described above, the vibration bias has the direct-current voltage component which is between the back part potential and the image part potential. In this case, however, the direct-current voltage component closer to the back part potential than to the image part potential is preferable, for preventing the toner adhesion to the back part potential zone.

The vibration bias voltage having the rectangular wave desirably has a duty ratio 50% or less. Hereinabove, the duty ratio is a time ratio of the toner moving to the photoconductor in one period of the vibration bias. With the definition of the duty ratio, the difference between the peak value and the bias time average value of the toner moving to the photoconductor may be increased, further activating the toner's movement and thereby the toner makes adhesion according to the potential distribution of the latent electrostatic image face, resulting in improvement of roughness and image resolution. Moreover, the difference between the peak value and the bias time average value of the carrier (having an opposite polarity to the toner) moving to the photoconductor can be decreased, inactivating the carrier's movement and thereby the probability of the carrier adhesion to the back section of the latent image may be. greatly decreased.

The image forming apparatus of the present invention has the charging apparatus which allows contact of the charging member with the latent image carrier, to thereby apply a voltage to the charging member.

<Roller Charging>

Figure 7A:
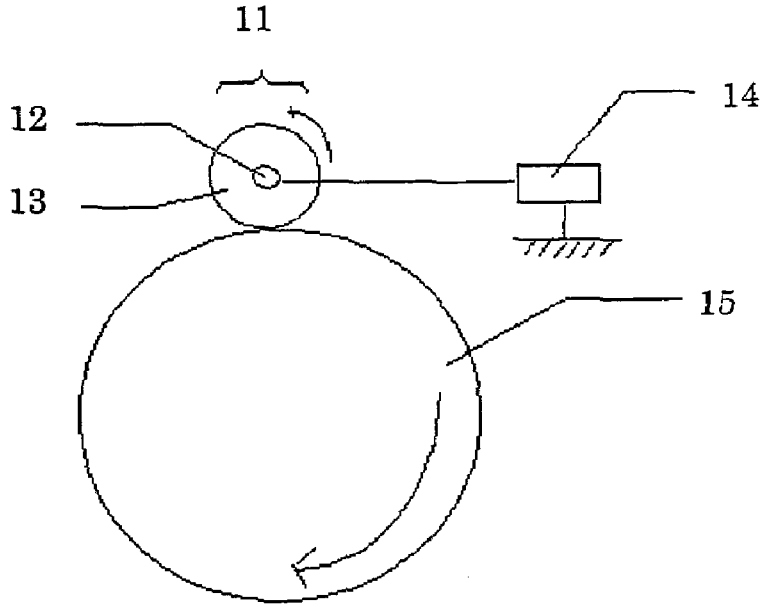

FIG. 7A shows a schematic of an example of an image forming apparatus using a contact-type charging apparatus. A photoconductor 15 as a charged body and as an image carrier may be driven in the arrow direction at a predetermined speed (process speed). A charge roller 11 which is a charging member contacting the photoconductor drum has a basic structure of a core 12 and a conductive rubber layer 13 formed on the roller in such a manner as to be concentrically united with an external periphery of the core 12. The core 12 has both ends rotatably held with a bearing member and the like (not shown). A pressure applying unit (not shown) may apply a predetermined pressure to the photoconductor drum. With the above, in FIG. 7A, the charge roller 11 may rotate following rotation of the photoconductor drum. With the core 12 having a diameter 9 mm coated with an intermediary resistance rubber layer about 100,000Ω·cm, the charge roller 11 has a diameter 16 mm.

The core 12 of the charge roller 11 and a power source 14 in FIG. 7A are electrically connected, the power source 14 applying a predetermined bias to the charge roller 11. With this, a peripheral face of the photoconductor 15 may be uniformly charged with a predetermined polarity and a predetermined potential.

Other than being in a form of roller, the charging member of the present invention may have any shape such as magnetic brush, fur brush and the like, namely, the shape thereof may be selected according to specification, mode and the like of the electrophotography apparatus. The magnetic brush uses various ferrite particles as the charging member, for example, Zn—Cu ferrite and the like. The magnetic brush has a non-magnetic conductive sleeve for supporting the charging member and a magnet roll which is encapsulated in the charging member.

Moreover, the fur brush has, as a material therefor, a fur which is subjected to a conductivity treatment with carbon, copper sulfide, metal, and metal oxide. The fur is to be wound around or attached to a metal or a core (which core is subjected to another conductivity treatment), to thereby form the charge device.

<Fur Brush Charging>

Figure 7B:
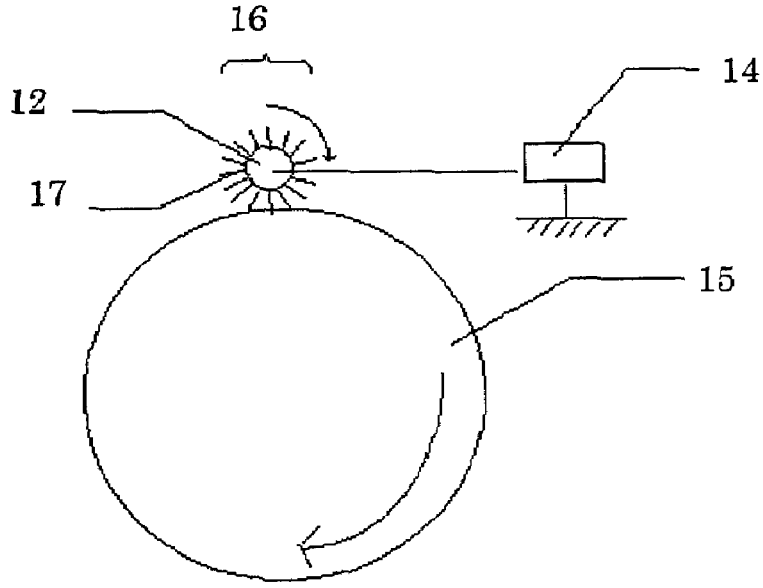
FIG. 7B shows an example of a brush contact charging apparatus.

FIG. 7B shows a schematic of an example of an image forming apparatus using a contact-type charging apparatus. The photoconductor 15 as a charged body and as an image carrier may be driven in the arrow direction at a predetermined speed (process speed). With a predetermined pressure, a brush roller 16 including a fur brush is caused to contact the photoconductor 15 with a predetermined nip width, against a resilience of a brush part 17.

The fur brush roller 16 as the contact charging member according to this embodiment has the following structure: a tape having a pile base which is a conductive RAYON fiber REC-B made by Unitika Ltd. is spirally wound around a metal core 12 (also act as an electric pole) having a diameter 6 mm, to thereby form a roll brush, as a brush part 17, having an external diameter 14 mm and a longitudinal length 250 mm.

The brush of the brush part 17 has 300 denier/50 filament, and a density of 155 per 1 square milli meter. The roll brush is to be inserted into a pipe with an internal diameter 12 mm, in such a manner as to rotate in one direction, thereby setting the brush and the pipe concentric with each other, followed by being left at rest in high temperature high humidity atmosphere, to thereby bring about an inclined brush having reformation.

The fur brush roller 16 has resistance $1\times10^5\Omega$ with an applied voltage 100 V. This resistance was converted from a current with an applied voltage 100 V when the fur brush roller 16 was caused to abut, with a nip width 3 mm, on a metal drum having diameter ϕ30 mm.

For preventing an image failure (charge failure of a charge nip part), the resistance of the fur brush charging device is $10^4\Omega$ or more. More specifically about the image failure: when a low-pressure resistance defect part such as pin hole and the like are caused to the photoconductor 15 (charged body), the image failure may be caused by an excessively large amount of leak current into the low-pressure resistance defect part. For introducing a sufficient electric charge into the photoconductor 15 surface, however, the resistance of the fur brush charging device is to be $10^7\Omega$ or less.

Example of the material for the brush include REC-B REC-C, REC-ML, and REC-M10 made by Unitika Ltd., other examples including, SA-7 made by Toray Industries. Inc., Sanderron made by Nihon Sanmo, belltron made by Kanebo, Ltd., clacarbo (carbon dispersed in RAYON) made by KURARAY CO., LTD., Roval made by Mitsubishi Rayon Co., Ltd., and the like. A single brush is preferred to be of 3 denier to 10 denier, and the brush is preferred to have 10 filament/bundle to 100 filament/bundle and density of 80 brush/mm to 600 brush/mm. Brush length is preferred to be 1 mm to 10 mm.

The fur brush roller is to be rotated at a predetermined circumferential speed (surface speed) in an opposite (counter) direction to the photoconductor's rotational direction, in such a manner as to contact the photoconductor face with a speed difference. Applying a predetermined charge voltage to the fur brush roller from a power source may subject the rotating photoconductor face to a uniform contact charging treatment with a predetermined polarity and a predetermined potential. According to this embodiment, in the contact charging of the photoconductor by the fur brush roller, a direct introduction charging is dominant, thereby charging the rotating photoconductor's surface at a potential substantially equal to the charge voltage applied to the fur brush roller.

Other than being in the form of the fur brush roller, the charging member of the present invention may be of any shape such as charge roller, fur brush and the like, and therefore may be selected according to specification and mode of the electrophotography apparatus. When the charge roller is used, in general, the core is to be coated with an intermediary resistance rubber layer about 100,000Ω·cm. As a charging member, various ferrite particles such as Zn—Cu ferrite and the like are used for the magnetic brush. In this structure, the magnetic brush is to be provided with a nonmagnetic conductive sleeve for supporting the charging member and with a magnet roll encapsulated in the charging member.

<Magnetic Brush Charging>

FIG. 7B shows a schematic of an example of an image forming apparatus using a contact-type charging apparatus. The photoconductor 15 as a charged body and as an image carrier may be driven in the arrow direction at a predetermined speed (process speed). With a predetermined pressure, a brush roller 16 including a magnetic brush is caused to contact the photoconductor 15 with a predetermined nip width, against a resilience of a brush part 17.

The magnetic brush as the contact charging member according to this embodiment uses the following magnetic particle: mixing a Zn—Cu ferrite particle having an average particle diameter 25 μm with a Zn—Cu ferrite particle having average particle diameter 10 μm at a mass ratio 1:0.05, and coating with an intermediary resistance resin layer a ferrite particle having an average particle diameter 25 μm (a peak positioned in respective average particle diameters). The contact charging member is constituted of a coat magnetic particle developed as described above, a nonmagnetic conductive sleeve for supporting the coat magnetic particle, and a magnet roll encapsulated in the nonmagnetic conductive sleeve, and the coat magnetic particle is coated on the sleeve in such a manner as to have thickness 1 mm, to thereby form, between the photoconductor 15 and the sleeve, a charge nip having a width about 5 mm. Moreover, a gap about 500 μm is formed between the magnetic particle holding sleeve and the photoconductor 15. Moreover, the magnet roll is rotated such that the sleeve surface is slidably moved in an opposite direction to the photoconductor 15 surface at twice the peripheral speed of the photoconductor 15 surface, causing the photoconductor 15 to uniformly contact the magnetic brush.

Other than being in the form of the magnetic brush, the charging member of the present invention may be of any shape such as charge roller 11, fur brush and the like, and therefore may be selected according to specification and mode of the electrophotography apparatus. When the charge roller 11 is used, in general, the core 12 is to be coated with an intermediary resistance rubber layer about 100,000Ω·cm. Moreover, the fur brush has, as a material therefor, a fur which is subjected to a conductivity treatment with carbon, copper sulfide, metal, and metal oxide. The fur is to be wound around or attached to a metal or a core 12 (which core 12 is subjected to another conductivity treatment), to thereby form the charge device.

(Process Cartridge)

A process cartridge of the present invention comprises a latent electrostatic image carrier that supports a latent electrostatic image, a developing unit for developing the latent electrostatic image using a developer to form a visible image, and other optional unit that are properly selected when needed.

The developing unit includes at least a developer container that contains a toner or a developer of the present invention, and a developer bearer that supports and carries the toner or developer. The developing unit may further include other components such as a layer thickness-controlling member that controls the thickness of toner layer formed on the carrier, and the like.

The process cartridge of the present invention may be detachably equipped in various electrophotographic apparatuses, and it is preferably equipped in an electrophotographic apparatus of the present invention.

Figure 8:
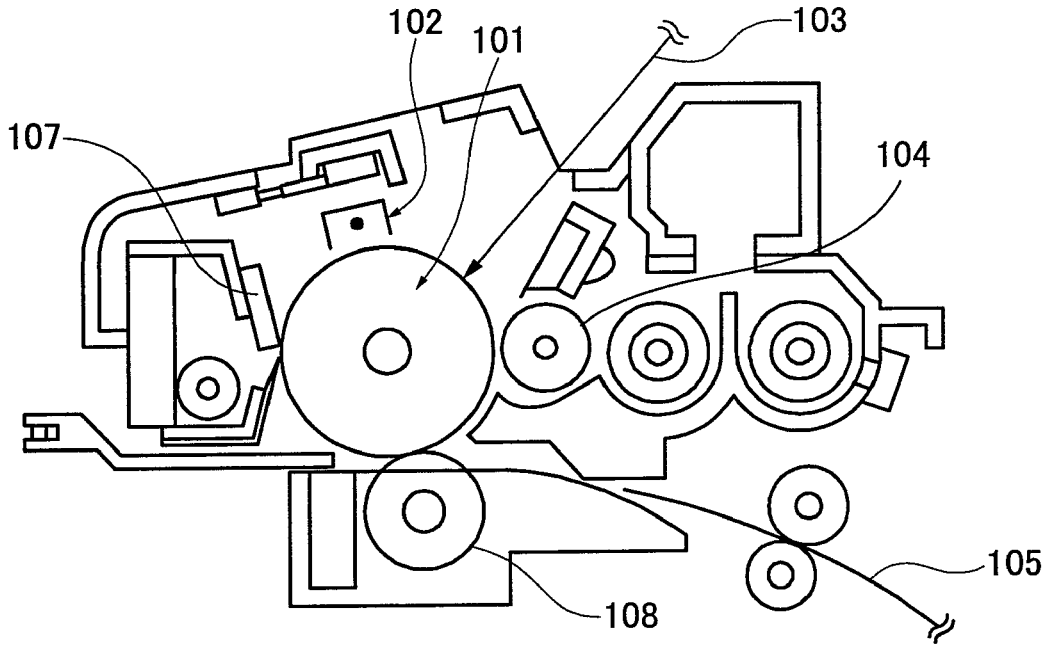
FIG. 8 is a schematic showing an example of a process cartridge of the present invention.

Herein, as is seen in FIG. 8, the process cartridge incorporates a photoconductor 101, a charging unit 102, a developing unit 104, a cleaning unit 107. Moreover, when necessary the process cartridge incorporates other unit(s).

The photoconductor 101 has a support and a photoconductive layer having at least a cross-link surface layer on the support.

The charging unit 102 may be those conventionally known.

An exposing unit 103 may be a light source capable of writing with high resolution.

(Toner)

For manufacturing the toner particle of the present invention, conventionally known methods are applicable such as a pulverizing method, a polymerizing method and the like. As long as meeting the inorganic fine particle (to be added to the toner) in an amount of 0.8% by mass to 3.0% by mass, the method for manufacturing the toner particle is not specifically limited.

The toner manufactured by the polymerizing method may, however, cause a cleaning failure due to a small amount of depression-protrusion of the surface shape. Of the present invention, the thus polymerized toner has particle diameter distribution with small variation, which is effective for stabilization and the like of chargeability.

Based on the above, hereinafter described are details about the polymerized toner of the present invention.

Among the polymerized toners, the toner obtained by the following operations is preferable for increased resin selectivity, increased low-temperature fixing property, excellent granularity, and easy control (of particle diameter, graininess distribution, and shape): 1) dissolving-dispersing, in an organic solvent, a toner material containing i) an active hydrogen group-contained compound and ii) a polymer reactive with the active hydrogen group-contained compound, to thereby prepare a toner solution, 2) emulsifying-dispersing the toner solution in an aqueous medium, to thereby prepare a dispersing liquid, 3) reacting, in the aqueous medium, i) the active hydrogen group-contained compound with ii) a polymer reactive with the active hydrogen group-contained compound, to thereby produce an adhesive base material in a form of a particle, and 4) removing the organic solvent, to thereby obtain the toner.

The toner material comprises i) an active hydrogen group-contained compound, ii) a polymer reactive with the active hydrogen group-contained compound, and iii) the adhesive base material obtained by a reaction with a binder resin, a releasing agent, and a colorant. Moreover, when necessary, the toner material comprises other compositions such as resin fine particle, charge controlling agent and the like.

The adhesive base material shows an adhesion property to a recording medium such as paper and the like, comprises an adhesive polymer obtained by reacting, in the aqueous medium, the active hydrogen group-contained compound with the polymer which is reactive with the active hydrogen group-contained compound, and may further comprise a binder resin properly selected from those conventionally known.

Specific examples of the adhesive base material is not specifically limited and therefore may be properly selected according to the object, namely, polyester resin and the like especially are preferable.

The polyester resin is not specifically limited and therefore may be properly selected according to the object, examples thereof including modified polyester resin and the like.

[Modified Polyester Resin (i)]

The modified polyester resin (i) has a structure i) where a bond group other than a functional group (contained in a monomer unit of acid and alcohol) and an ester bond is present, and ii) where a different-structure resin component is bonded by a covalent bond, ion bond and the like.

Examples of the, modified polyester resin (i) include those having a polyester terminal end which is reacted with a material other than the ester bond, more specifically, the polyester terminal end introducing a functional group such as isocyanate group which reacts with an acid group and a hydroxyl group, and further reacting with an active hydrogen compound for modifying the polyester terminal end or causing elongation reaction.

Moreover, as long as being a compound having a plurality of active hydrogen groups, those having the polyester terminal ends bonded together may also be included (urea-modified polyester, urethane-modified polyester and the like).

Moreover, the modified polyester resin (i) also includes those introducing a reactive group (such as double bond) into a polyester main chain, then causing a radical polymerization to thereby introduce to a side chain a graft component of carbon-carbon bond or bridging the double bonds together (styrene-modified polyester, acrylic-modified polyester and the like).

Moreover, the modified polyester resin (i) also includes those copolymerizing, in the polyester's main chain, different-structure resin components or those reacted with carboxyl group or hydroxyl group at the terminal end. For example, those having the terminal end copolymerized with a silicone resin modified by carboxyl group, hydroxyl group, epoxy group, and mercapto group are also included (silicone-modified polyester and the like).

Specific descriptions thereof are made hereinafter.

[Synthesis Example of Polystyrene Modified Polyester Resin (i)]

Into a reaction vessel provided with a cooling pipe, a stirrer and a nitrogen introduction pipe, bisphenol A ethyleneoxide 2 mol adduct 724 mass parts, isophthalic acid 200 mass parts, fumaric acid 70 mass parts, dibutyl tin oxide 2 mass parts was introduced, followed by reaction under an ordinary pressure at 230° C. for 8 hours, followed by a reaction under a decreased pressure 10 mmHg to 15 mmHg for 5 hours, still followed by cooling to 160° C., then phthalic anhydride 32 mass parts was added for reaction for 2 hours.

Then, the resultant was cooled to 80° C., followed by adding styrene 200 mass parts, benzoyl peroxide 1 mass part, and dimethyl aniline 0.5 mass part into ethyl acetate for reaction for 2 hours, followed by distillation of the ethyl acetate for removal thereof, to thereby obtain polystyrene graft modified polyester resin (i) having weight average molecular weight 92,000.

[Urea Modified Polyester Resin (i)]

Examples of urea-modified polyester (i) include a reactant and the like where polyester prepolymer (A) (which contains isocyanate group) is reacted with amines (B).

Examples of the isocyanate group-contained polyester prepolymer (A) include the one made by the following operation: prepare a polyester which is polycondensation of a polyol (1) with a polycarboxylic acid (2) and which has an active hydrogen group, then react the polyester with polyisocyanate (3).

Examples of the active hydrogen group of the polyester include hydroxyl group (alcoholic hydroxyl group and phenolic hydroxyl group), amino group, carboxyl group, mercapto group and the like, preferably the alcoholic hydroxyl group.

Examples of the polyol (1) include diol (1-1) and trivalent or more polyol (1-2). The diol (1-1) alone is preferable, and a mixture of a small amount of the diol (1-1) with and the trivalent or more polyol (1-2) is also preferable.

Examples of the diol (1-1) include alkylene glycol (ethylene glycol, 1,2-propylene glycol, 1,3-propylene glycol, 1,4-butane diol, 1,6-hexane diol and the like); alkylene ether glycol (diethylene glycol, triethylene glycol, dipropylene glycol, polyethylene glycol, polypropylene glycol, polytetramethylene ether glycol and the like); alicyclic diol (1,4-cyclohexane dimethanol, hydrogenated bisphenol A and the like); bisphenols (bisphenol A, bisphenol F, bisphenol S and the like); alkylene oxide adduct (ethylene oxide, propylene oxide, butylene oxide and the like) of the above alicyclic diol; alkylene oxide adduct (ethyleneoxide, propylene oxide, butylene oxide and the like) of the bisphenols and the like.

Among the above, i) the alkylene glycol having carbon number 2 to 12 and ii) the alkylene oxide adduct of bisphenols are preferable, and a combination of ii) the alkylene oxide adduct of bisphenols with i) the alkylene glycol having carbon number 2 to 12 is especially preferable.

Moreover, examples of the trivalent or more polyol (1-2) include polyvalent aliphatic alcohol (glycerin, trimethylol ethane, trimethylol propane, pentaerythritol, sorbitol and the like) which is trivalent to octavalent or more; trivalent or more phenols (trisphenol PA, phenol novolac, cresol novolac and the like); alkylene oxide adduct of the above trivalent or more polyphenols; and the like.

Examples of the polycarboxylic acid (2) include dicarboxylic acid (2-1) and trivalent or more polycarboxylic acid (2-2). The dicarboxylic acid (2-1) alone is preferable, and a mixture of a small amount of the dicarboxylic acid (2-1) with the trivalent or more polycarboxylic acid (2-2) is also preferable.

Examples of the dicarboxylic acid (2-1) include alkylene dicarboxylic acid (succinic acid, adipic acid, sebacic acid and the like); alkenylene dicarboxylic acid (maleic acid, fumaric acid and the like); aromatic dicarboxylic acid (phthalic acid, isophthalic acid, terephthalic acid, naphthalene dicarboxylic acid and the like) and the like.

Among the above, the alkenylene dicarboxylic acid having carbon number 4 to 20 and the aromatic dicarboxylic acid having carbon number 8 to 20 are preferable.

Examples of the trivalent or more polycarboxylic acid (2-2) include aromatic polycarboxylic acid (trimellitic acid, pyromellitic acid and the like) having carbon number 9 to 20, and the like.

An acid anhydride or a lower alkyl ester (methyl ester, ethyl ester, isopropyl ester and the like) of the above polycarboxylic acid (2) may be reacted with the polyol (1).

The ratio of the polyol (1) to the polycarboxylic acid (2), that is, an equivalent ratio [OH]/[COOH] of hydroxyl group [OH] to carboxyl group [COOH] is typically 2/1 to 1/1, preferably 1.5/1 to 1/1, and more preferably 1.3/1 to 1.02/1.

Examples of the polyisocyanate (3) include aliphatic polyisocyanate (tetramethylene diisocyanate, hexamethylene diisocyanate, 2,6-diisocyanato methylcaproate and the like); alicyclic polyisocyanate (isophorone diisocyanate, cyclohexyl methane diisocyanate and the like); aromatic diisocyanate (tolylene diisocyanate, diphenyl methane diisocyanate and the like); aromatic aliphatic diisocyanate (α, α, α', α'-tetramethyl xylylene diisocyanate and the like); isocyanurates; the above polyisocyanate blocked with phenol derivative, oxime, caprolactum and the like. The above polyisocyanate (3) may be used alone or in combination of two or more.

The ratio of the polyisocyanate (3), that is, an equivalent ratio [NCO]/[OH] of isocyanate group [NCO] to hydroxyl group-contained polyester hydroxyl group [OH] is typically 5/1 to 1/1, preferably 4/1 to 1.2/1, more preferably 2.5/1 to 1.5/1. The [NCO]/[OH] more than 5 is likely to degrade the low-temperature fixing property.

The mol ratio [NCO] less than 1 may decrease urea content in the modified polyester, degrading hot offset property.

Content of the structural component of the polyisocyanate (3) in the prepolymer (A) having the isocyanate group at the terminal end is typically 0.5% by mass to 40% by mass, preferably 1% by mass to 30% by mass, and more preferably 2% by mass to 20% by mass.

Less than 0.5% by mass is likely to degrade the hot offset property, and compatibility of heat preservability with the low-temperature fixing property. On the other hand, more than 40% by mass is likely to degrade the low-temperature fixing property.

Examples of amines (B) for preparing the urea modified polyester resin (i) include diamines (B1), polyamines having 3 or more amino groups (B2), amino alcohols (B3), amino mercaptans (B4), amino acids (B5), derivatives of (B1) to (B5) in which the amino groups are blocked (B6), and the like.

Examples of diamines (B1) include aromatic diamines (phenylene diamine, diethyltoluene diamine, 4,4'-diamino diphenyl methane, and the like); alicyclic diamines (4,4'-diamino-3,3'-dimethyl dicyclohexyl methane, diamine cyclohexane, isophorone diamine, and the like); aliphatic diamines (ethylene diamine, tetramethylene diamine, hexamethylene diamine, and the like); and the like.

Examples of polyamines having 3 or more amino groups (B2) include diethylene triamine, triethylene tetramine, and the like.

Examples of amino alcohols (B3) include ethanol amine, hydroxy ethyl aniline, and the like. Examples of amino mercaptans (B4) include aminoethyl mercaptan, aminopropyl mercaptan, and the like.

Examples of derivatives of (B1) to (B5) in which the amino groups are blocked (B6) include ketimine compounds and oxazoline compounds that are obtained from amines of (B1) to (B5) and ketones (acetone, methyl ethyl ketone, methyl isobutyl ketone, and the like), and other compounds. Among these amines (B), (B1) is preferable, and a mixture of (B1) and a small amount of (B2) is also preferable.

Additionally, an inhibitor may, when needed, to adjust the molecular weight of the modified polyester. Examples of the inhibitors include monoamines (diethylamine, dibutylamine, butylamine, laurylamine, and the like), those that are blocked (ketimine compounds), and the like.

The ratio of amines (B) by the equivalent ratio of isocyanate groups (NCO) in the isocyanate group-contained prepolymer (A) to amino groups (NHx) in the amines (B), [NCO]/[NHx], is typically 1/2 to 2/1, preferably 1.5/1 to 1/1.5, and more preferably 1.2/1 to 1/1.2.

When the ratio [NCO]/[NHx] is more than 2 or less than 1/2, the molecular weight of the urea modified polyester (i) will be low and its hot offset property will be degraded.

Of the present invention, the modified polyester resin (i) may contain a urethane bond in combination with the urea bond. The mol ratio of the urea bond content to the urethane bond content is typically 100/0 to 10/90, preferably 80/20 to 20/80, and more preferably, 60/40 to 30/70. The mol ratio of urea bond of less than 10% is likely to degrade the hot offset property.

The modified polyester resin (i) of the present invention may be manufactured by a one shot method and a prepolymer method.

The modified polyester resin (i) typically has a preferable weight average molecular weight 10,000 or more, more preferably 20,000 to 10,000,000 and especially preferable 30,000 to 1,000,000. The above weight average molecular weight less than 10,000 is likely to degrade the hot offset property.

When an after-described unmodified polyester resin (LL) is used, the number average molecular weight of the modified polyester resin (i) is not specifically limited, the one that may easily obtain the above weight average molecular weight is preferable.

When the modified polyester resin (i) is used alone, typically the number average molecular weight is preferably 20,000 or less, more preferably 1,000 to 10,000, and especially preferably 2,000 to 8,000. The number average molecular weight more than 20,000 is likely to degrade glossiness when the modified polyester resin (i) is used for the low-temperature fixing property apparatus and the full color apparatus.

[Unmodified Polyester Resin (LL)]

Of the present invention, not limited to use of the modified polyester resin (i) alone, an unmodified polyester resin (LL) may be contained as the toner binder resin component in combination with the modified polyester resin (i).

Combining the unmodified polyester resin (LL) may improve the glossiness when the low-temperature fixing property apparatus and the full color apparatus are used, which is more preferable than use of the modified polyester resin (i) alone.

Examples of the unmodified polyester resin (LL) include a polyester component like the one described in the modified polyester resin (i), which is a polycondensation of the polyol (1) with the polycarboxylic acid (2); and the like. Preferable examples thereof are like those of the modified polyester resin (i).

Moreover, in view of the low-temperature fixing property and the hot offset property, it is preferable that at least a part of the modified polyester resin (i) and a part of the unmodified polyester resin (LL) are compatible. Therefore, the polyester component of the modified polyester resin (i) and the polyester component of the unmodified polyester resin (LL) are preferably similar.

When the unmodified polyester resin (LL) is contained, typically, the mass ratio of the modified polyester resin (i) to the unmodified polyester resin (LL) is preferably 5/95 to 80/20, more preferably 5/95 to 30/70, moreover preferably 5/95 to 25/75, and especially preferably 7/93 to 20/80.

The mass ratio of the modified polyester resin (i) less than 5% is likely to degrade the hot offset property, and be disadvantageous for compatibility of the heat preservability with the low-temperature fixing property.

Typically, the peak molecular weight of the unmodified polyester resin (LL) is preferably 1,000 to 20,000, more preferably 1,500 to 10,000, and especially preferably 2,000 to 8,000. The peak molecular weight 1,000 less than is likely to degrade the heat preservability, while more than 10,000 is likely to degrade the low-temperature fixing property.

The hydroxyl group value of the unmodified polyester resin (LL) is preferably 5 mgKOH/g or more, more preferably 10 mgKOH/g to 120 mgKOH/g, and especially preferably 20 mgKOH/g to 80 mgKOH/g. The hydroxyl group value less than 5 mgKOH may be disadvantageous for compatibility of the heat preservability with the low-temperature fixing property.

The acid value of the unmodified polyester resin (LL) is preferably 10 mgKOH/g to 30 mgKOH/g. With the acid value imparted, the unmodified polyester resin (LL) may be likely to be negatively charged and have better fixing property.

Of the present invention, the unmodified polyester resin (LL) typically has a preferable glass transition point (Tg) 35° C. to 55° C., and more preferably 40° C. to 55° C., enabling compatibility of the toner's heat preservability and the toner's low-temperature fixing property. With the coexistence of the modified polyester resin (i), the dry toner of the present invention may show better heat preservability than the conventionally known polyester toner, even when the glass transition point is low.

Of the present invention, typically, a temperature (TG') causing a storage resilient ratio 10,000 dyne/cm$^2$ (storage resilient ratio of the binder resin constituting the toner) at measurement frequency 20 Hz is preferably 100° C. or more, and more preferably 110° C. to 200° C. The temperature (TG') less than 100° C. is likely to degrade the hot offset property.

Moreover, in view of the viscosity of the binder resin of the toner, typically, a temperature (Tη) causing 1,000 poise at measurement frequency 20 Hz is preferably 180° C. or less, and more preferably 90° C. to 160° C. More than 180° C. is likely to degrade the low-temperature fixing property.

In sum, from the viewpoint of compatibility of the low-temperature fixing property and the hot offset property, the temperature TG' is preferably higher than the temperature TV. In other words, a difference (TG'−Tη) is preferably 0° C. or more, more preferably 10° C. or more, and especially preferably 20° C. or more. An upper limit of the difference (TG'−Tη) is not specifically limited.

Moreover, from the viewpoint of compatibility of the heat preservability and the low-temperature fixing property, difference between the temperature Tη and the glass transition point Tg is preferably 0° C. to 100° C., more preferably 10° C. to 90° C., and especially preferably 20° C. to 80° C.

For a colorant of the present invention, any dye or pigment well known in the art can be used. Examples of the colorant include carbon black, nigrosine dye, iron Black, naphthol yellow S, Hanza yellow (10G, 5G, G), cadmium yellow, yellow iron oxide, ocher, chrome yellow, titanium yellow, polyazo yellow, oil yellow, Hanza yellow (GR, A, RN, R), pigment yellow L, benzidine yellow (G, GR), permanent yellow (NCG), Vulcan fast yellow (5G, R), tartrazine lake, quinoline yellow lake, anthracene yellow BGL, isoindolinone yellow, red iron oxide, minium, lead vermilion, cadmium red, cadmium mercury red, antimony vermilion, Permanent-Red 4R, Para Red, Fire Red, p-chloro-o-nitroaniline red, risol fast scarlet, brilliant fast scarlet, Brilliant Carmine BS, permanent red (F2R, F4R, FRL, FRLL, F4RH), fast scarlet VD, Vulcan Fast Rubine B, brilliant scarlet G, Lithol Rubine GX, permanent-Red F5R, brilliant carmine 6B, Pigment Scarlet 3B, Bordeaux 5B, Toluidine Maroon, Permanent Bordeaux F2K, Helio Bordeaux BL, bold 10B, BON Maroon Light, BON Maroon Medium, eosine lake, rhodamine lake B, rhodamine lake Y, alizarin lake, Thioindigo Red B, Thioindigo Maroon, oil red, quinacridone red, pyrazolone red, polyazo red, chrome vermilion, benzidine orange, Perynone Orange, oil orange, cobalt blue, cerulean blue, alkali blue lake, peacock blue lake, Victoria blue lake, non-metallic phthalocyanine blue, phthalocyanine-blue, fast sky blue, Indanthrene Blue (RS, BC), indigo, ultramarine blue, Berlin blue, anthraquinone blue, fast violet B, methyl violet lake, cobalt purple, manganese purple, dioxane violet, anthraquinone violet, chrome green, zinc green, chrom oxide, viridian, emerald green, pigment green B, naphthol green B, green gold, acid green lake, malachite-green lake, phthalocyanine green, anthraquinone green, titanium oxide, zinc white, lithopone, and mixtures thereof, and the like.

The content of the colorant is typically 1% by mass to 15% by mass, and is preferably 3% by mass to 10% by mass, relative to the toner.

A colorant of the present invention can be combined with a resin and used as a master batch.

For the manufacture of a master batch, various materials can be used as a binder resin that is mixed-kneaded with a colorant in addition to the modified and unmodified polyesters mentioned above, for example, polymers of styrene or substituted styrenes such as polystyrene, poly p-chlorostyrene, polyvinyl toluene, and the like; styrene copolymers such as styrene-p-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene acrylonitrile copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymers, and the like; polymethyl methacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin, paraffin wax, and the like. These may be used either alone or in combination of two or more.

The master batch can be obtained by mixing and kneading a resin for master batch and a colorant with a high shear force.

In order to enhance the interaction between the colorant and the resin, an organic solvent may be used. Also, the so-called flushing method may be used in which an aqueous paste of a colorant that contains water is mixed and kneaded together with a resin and an organic solvent, thereby transferring the colorant to the resin, and the water content and organic solvent components are removed thereafter. This method is preferred because a wet cake of the colorant can be used as it is and there is no need for drying.

For the mixing and kneading, a high shear dispersing machine such as a three-roller mill, and the like is preferably used.

—Wax—

The toner of the present invention may contain wax as a releasing agent.

After studying, the present inventors have found that the wax in the toner may greatly influence the toner's releasability in the fixing, and that the wax finely dispersed in the toner and present in a great amount in the toner and near the surface can bring about a preferable fixing releasability.

Especially preferably, the wax is so dispersed in such a manner as to have a long diameter 1 μm or less.

When a great amount of releasing agents are exposed on the toner surface, however, the wax is likely, to be removed from the toner surface with a long-term stirring in the developing apparatus. With this, the wax may adhere to the carrier surface or to the surface of the member in the developing apparatus, decreasing charging amount of the developer, which is not preferable.

Herein, the dispersion state of the releasing agent may be determined from an enlarged photograph taken with a transparent electron microscope.

The wax may be any of those known in the art. Examples of the wax include polyolefin waxes (polyethylene wax, polypropylene wax, and the like); long chain hydrocarbons (paraffin wax, Sasol wax, and the like); carbonyl group-contained waxes, and the like. Of these, the carbonyl group-contained waxes are preferred. Examples of the carbonyl group-contained waxes include polyalkane acid esters (carnauba wax, montan wax, trimethylolpropane tribehenate, pentaerythritol tetrabehenate, pentaerythritol diacetate dibehenate, glycerine tribehenate, 1,18-octadecanediol distearate, and the like); polyalkenol esters (tristearyl trimellitate, distearyl maleate, and the like); polyalkane acid amides (ethylenediamine dibehenylamide, and the like); polyalkylamides (trimellitic tristearylamides, and the like); dialkyl ketones (distearylketone, and the like), and the like.

Of the carbonyl group-contained waxes, the polyalkane acid esters are preferred.

The melting point of the wax used in the present invention is typically 40° C. to 160° C., preferably 50° C. to 120° C., and more preferably 60° C. to 90° C. When the melting point of the wax is less than 40° C., there is an adverse effect on anti-heat preservability. When the melting point of the wax is more than 160° C., cold offset during fusing tends to occur at low temperature.

Further, the melt viscosity of the wax at a temperature 20° C. higher than the melting point is preferably 5 cps to 1,000 cps, and more preferably 10 cps to 100 cps. When the melt viscosity of the wax is more than 1,000 cps, there is not much improvement of hot offset property and low-temperature fixing property. The content of the wax in the toner is typically 0% by mass to 40% by mass, preferably 3% by mass to 30% by mass.

(Charge Controlling Agent)

A toner of the present invention may further contain a charge controlling agent when needed (otherwise, referred to as "charge control material").

Especially, fixing the charge control material to the toner's surface may impart thereto a high charging amount.

In other words, fixing the charge control material to the toner's surface may stabilize amount and state of the charge controlling agent, thereby stabilizing the charging amount. Especially, the toner having the structure of the present invention can be stabilized in terms of the charging amount.

Any of the charge control substances known in the art may be used. Examples of the charge controlling agent include negrosine dyes, triphenylmethane dyes, chrome-contained metal complex dyes, chelate molybdate pigments, rhodamine dyes, alkoxy amines, quaternary ammonium salts (including fluorinated quaternary ammonium salts), alkyl amides, phosphorus and its compounds, tungsten and its compounds, fluorine activating agents, metal salicilates, metal salts of salicylic acid derivatives, and the like.

Specific examples are Bontron 03 as the negrosine dye, Bontron P-51 as the quaternary ammonium salt, Bontron S-34 as the metal-contained azo dye, oxynaphthoic acid metal complex E-82, the salicylic acid metal complex E-84, the phenolic condensate E-89 (available from Orient Chemical Industries), the quaternary ammonium salt molybdenum complexes TP-302, TP-415 (available from Hodogaya Chemical Industries), the quaternary ammonium salt Copy Charge PSY VP2038, the triphenylmethane derivative Copy Blue PR, the quaternary ammonium salts Copy Charge NEG VP2036 and Copy Charge NX VP434 (available from Hoechst), LRA-901, LR-147 as the boron complex (available from Japan Carlit Co., Ltd.), copper phthalocyanine, perylene, quinacridone, azo pigments, and other polymer compounds containing a functional groups such as sulfonic acid group, carboxyl group, quaternary ammonium salt, and the like.

The consumed quantity of the charge controlling agent of the present invention is determined according to the type of the binder resin, the presence or absence of additives that are used when necessary, and the process for manufacturing the toner including the dispersing method, and therefore there is no universal limitation. However, the consumed quantity of the charge controlling agent is preferably 0.1 mass part to 10 mass parts relative to 100 mass parts of the binder resin, more preferably 0.2 mass part to 5 mass parts. When the consumed quantity of the charge controlling agent is more than 10 mass parts, the chargeability of the toner is excessively large, the effect of the main charge controlling agent is diminished, and the electrostatic attraction with the developing roller increases, resulting in a deterioration in fluidity of the developer and decrease of image density.

The charge controlling agent and the releasing agent may be melted-kneaded together with the master batch and the resin and then dissolved and dispersed, of course, may naturally be added upon dissolution or dispersion in an organic solvent.

—Cleanability Improving Agent—

A cleanability improving agent that helps remove the developer remaining on a photoconductor or a primary transfer medium after the transfer can be added to a toner.

Examples of the cleaneability improving agent include fatty acid metal salts such as zinc stearate, calcium stearate, stearic acid, and the like; polymer particles manufactured by soap-free emulsification polymerization and the like such as polymethyl methacrylate particles, polystyrene particles; and the like.

The resin particles preferably have a relatively narrow particle size distribution, and a volume mean particle diameter 0.01 μm to 1 μm.

The resin particles can be made of any resin, thermoplastic or thermosetting, as long as they are capable of forming an aqueous dispersion.

Examples thereof include vinyl resins, polyurethane resins, epoxy resins, polyester resins, polyamide resins, polyimide resins, silicon resins, phenol resins, melamine resins, urea resins, aniline resins, ionomer resins, polycarbonate resins, and the like. Two or more of these resins may be used in combination for the resin particles.

Among these, from the standpoint of the capability to obtain an aqueous dispersion of the spherical resin particles, vinyl resins, polyurethane resins, epoxy resins, polyester resins, and combinations thereof are preferable.

Vinyl resins include polymers and copolymers of vinyl monomers such as styrene-(meth)acrylate resin, styrene-butadiene copolymer, (meth)acrylate-acrylate polymer, styrene-acrylonitrile copolymer, styrene-maleic acid anhydride copolymer, styrene-(meth)acrylate copolymer, and the like.

The fine particle resin has a preferable average particle diameter 5 nm to 2,000 nm, and more preferably 20 nm to 300 nm.

<Toner Manufacturing Method>

Hereinafter described is a dry toner manufacturing method of the present invention. The present invention is, however, not limited thereto.

—Melting-mixing-kneading-pulverizing Method—

The materials constituting the toner such as the modified polyester resin (i)-contained binder resin, the charge controlling agent and the pigment are to be mechanically mixed. This mixing operation, is not specifically limited and therefore may be carried out under an ordinary condition where an ordinary mixer having a rotating vane is used.

After completion of the mixing operation, the mixture is to be introduced into a mixer-kneader for melting-mixing-kneading. Examples of the melter-mixer-kneader include a continuous mixer-kneader (single shaft, double shaft), batch-type mixer-kneader with a roll mil, and the like.

It is important to carry out the melting-mixing-kneading under a proper condition where molecular chain of the binder resin is not cut. Specifically, the melting-mixing-kneading is to be generally carried out referring to the softening point of the binder resin. Far lower than the softening point may violently cut the molecular chain of the binder resin, while far higher than the softening point may prevent progression of the dispersion.

After completion of the above melting-mixing-kneading operation, the thus obtained mixed-kneaded product is to be pulverized.

In the pulverizing operation, at first, preferably, a coarse pulverizing is to be carried out, followed by a fine pulverizing. In this case, such methods are preferable as i) impacting the mixed-kneaded product to an impact plate in a jet airflow for pulverizing, and ii) pulverizing the mixed-kneaded product in a narrow gap between a rotor and a stator which are mechanically rotating.

After completion of the pulverizing operation, the thus pulverized products are to be classified by a centrifugal force and the like in an airflow, to thereby manufacture the toner having a predetermined particle diameter, for example, an average particle diameter 5 μm to 20 μm.

In the preparation of the toner, for improving the toner's fluidity, preservability, developability, transferability, the above manufactured toner is to be mixed with an inorganic fine particle such as hydrophobic silica fine particle and the like.

The mixing of the inorganic fine particle is carried out with a general powder mixer, which is preferably provided with a jacket and the like for adjusting an internal temperature. For varying the hysteresis of the load applied to the inorganic fine particle (otherwise, referred to as "external additive") added to the toner, the external additive is to be added gradually. In this case, of course, the mixer's rotation speed, rolling speed, time, temperature may be varied. Applying at first a strong load followed by a comparatively weak load is allowed, otherwise the opposite thereto is also allowed.

Examples of the usable mixer include V-type mixer, rocking mixer, Redige mixer, Nauta mixer, Henschel mixer and the like.

For forming the thus obtained toner into a sphere, the following methods are to be used, but not limited thereto: i) The toner's structural materials including at least the binder resin and the colorant are to be subjected to the melting-mixing-kneading and pulverizing into fine particles, then the thus obtained fine-pulverized product is to be mechanically formed into the sphere with Hybridizer, Mechano Fusion and the like, ii) so-called a spraying-drying method where the toner material is to be dissolved-dispersed in a solvent which is capable of dissolving the binder resin, and then a spraying-drying apparatus is to be used for removing the solvent, to thereby obtain the spherical toner, and iii) heating the toner's structural materials in an aqueous medium.

—Toner Manufacturing Method in Aqueous Medium—

The aqueous medium of the present invention may be water alone, or a combination of the water with a solvent which is mixable with the water.

Examples of the mixable solvent include alcohol (methanol, isopropanol, ethylene glycol and the like), dimethyl formamide, tetrahydrofuran, cellusolves (methyl cellosolve and the like), lower ketones (acetone, methyl ethyl ketone and the like) and the like.

The toner particle may be formed by reacting, in the aqueous medium, the dispersoid (which is the isocyanate group-contained prepolymer (A)) with the amines (B). Or use of the modified polyester resin (i) manufactured in advance is allowed.

Examples of the method of stably forming the dispersoid (made from the modified polyester resin (i), the prepolymer (A) and the like) in the aqueous medium include the following: In the aqueous medium, the toner raw material composition (made from the modified polyester resin (i), prepolymer (A) and the like) is to be added, followed by dispersing with a shearing force.

The prepolymer (A) and other toner compositions (hereinafter, referred to as "toner raw material" as the case may be) may be mixed in the forming of the dispersoid in the aqueous medium, where the other toner compositions include colorant, the colorant master batch, the releasing agent, the charge controlling agent, the unmodified polyester resin (LL) and the like. More preferably, however, the toner raw material is to be mixed in advance, followed by adding the thus obtained mixture in the aqueous medium, to thereby carry out the dispersing.

Moreover, of the present invention, the other toner raw materials such as the colorant, the releasing agent, the charge controlling agent and the like are not necessarily be mixed in advance for the forming of the particle in the aqueous medium, instead, can be added after the forming of the particle. For example, after forming of the colorant-noncontained particle, a conventionally known dying method may be used for adding the colorant.

Adding the solid fine particle dispersant in advance into the liquid phase may unify the oil droplet dispersion in the liquid phase.

With this, the solid fine particle dispersant may be located on the oil droplet's surface in the dispersing, equalizing the oil droplet dispersion and preventing coagulation of the oil droplets, to thereby obtain the toner having a sharp graininess distribution.

The solid fine particle dispersant is present in a form of solid which is unlikely to be dissolved in the aqueous medium, the inorganic fine particle preferably having an average particle diameter 0.01 μm to 1 μm.

Specific examples of the inorganic particles include silica, alumina, titanium oxide, barium titanate, magnesium titanate, calcium titanate, strontium titanate, zinc oxide, tin oxide, silica sand, clay, mica, silicic pyroclastic rock, diatomite, chromium oxide, cerium oxide, red iron oxide, antimony trioxide, magnesium oxide, zirconium oxide, barium sulfate, barium carbonate, calcium carbonate, silicon carbide, silicon nitride, and the like.

Among the above, tricalcium phosphate, calcium carbonate, colloidal titanium oxide, colloidal silica, hydroxyapatite, and the like are preferably used.

Especially preferable is the hydroxyapatite which is made by reacting and synthesizing in water the sodium phosphate with calcium chloride under a basic condition.

There is no particular limitation on the dispersing method which may employ any dispersion apparatus known in the art such as low speed shear, high speed shear, friction, high-pressure jet, ultrasound, and the like.

To obtain dispersed particles having a diameter 2 μm to 20 μm, the high speed shear is preferred. When a high speed shear dispersion apparatus is used, there is no particular limitation on the rotation speed, but is typically 1,000 rpm to 30,000 rpm, and is preferably 5,000 rpm to 20,000 rpm.

There is no particular limitation on the dispersion time, but in the case of a batch process, the dispersion time is typically 0.1 minute to 5 minutes. The temperature at which a dispersion is prepared is typically 0° C. to 150° C. (under pressure), preferably 40° C. to 98° C.

When a higher temperature is used, the viscosity of the dispersoid comprising the modified polyester resin (i) and the prepolymer (A) is lower, and dispersing is easier, which is desirable.

The consumed quantity of the aqueous medium relative to 100 mass parts of the toner composition comprising the modified polyester resin (i) and the prepolymer (A) is typically 50 mass parts to 2,000 mass parts, and is preferably 100 mass parts to 1,000 mass parts. When the consumed quantity of the aqueous medium is less than 50 mass parts, the dispersion state of the toner composition is poor, and toner particles having the predetermined particle diameter may not be obtained. When the consumed quantity of the aqueous medium is more than 2,000 mass parts, it is not economical.

The use of a dispersion agent, when necessary, makes the particle distribution narrow and stabilizes the dispersion, and is therefore preferable.

Examples of dispersion agents which can be used to emulsify and disperse the oil phase in which the toner composition is dispersed, in an aqueous phase, are anionic surfactants such as alkyl benzene sulfonates, α-olefin sulfonates, phosphoric acid esters, and the like; amine salts such as alkylamine salts, aminoalcohol fatty acid derivatives, polyamine fatty acid derivatives, imidazoline, and the like; quaternary ammonium salt cationic surfactants such as alkyltrimethyl ammonium salts, dialkydrimethyl ammonium salts, alkyl dimethyl benzyl ammonium salts, pyridinium salts, alkyl isoquinolinium salts, benzetonium chloride, and the like; non-ionic surfactants such as fatty acid amide derivatives, polyvalent alcohol derivatives, and the like; amphoteric surfactants such as aniline, dodecyldi(aminoethyl)glycine, di(octyl aminoethyl) glycine, N-alkyl-N, N-dimethyl ammonium betaine, and the like; and the like.

By using a surfactant having a fluoroalkyl group, the effect can be obtained with an extremely small amount of the surfactant.

Examples of anionic surfactants having a fluoroalkyl group which can be conveniently used are fluoroalkyl carboxylic acids having 2 to 10 carbon atoms and metal salts thereof, disodium perfluorooctane sulfonyl glutamate, sodium 3-[omega-fluoroalkyl (C6 to C11) oxy]-1-alkyl (C3 to C4) sulfonate, sodium 3-[omega-fluoroalkanoyl (C6 to C8)-N-ethylamino]-1-propane sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonates and metal salts thereof, perfluorooctanesulfonic acid diethanolamide, N-propyl-N-(2-hydroxyethyl) perfluorooctane sulfonamide, perfluoroalkyl (C6 to C10) sulfonamide propyltrimethylammonium salt, perfluoroalkyl (C6 to C10)-N-ethylsulfonyl glycine salt, monoperfluoroalkyl (C6 to C16) ethyl phosphoric acid ester, and the like.

Examples of the commercial products are Surflon S-111, Surflon S-112, Surflon S-113 (available from Asahi Glass Co., Ltd.), Fluorad FC-93, Fluorad FC-95, Fluorad FC-98, Fluorad FC-129 (available from Sumitomo 3M, Co., Ltd.), Unidyne DS-101, DS-102 (available from Daikin Industries, Ltd.), Megaface F-110, Megaface F-120, Megaface F-113, Megaface F-191, Megaface F-812, Megaface F-833 (available from Dainippon Ink and Chemicals Incorporated), Eftop EF-102, EF-103, EF-104, EF-105, EF-112, EF-123A, EF-123B, EF-306A, EF-501, EF-201, EF-204 (available from JEMCO Inc.), FTERGENT F-100, FTERGENT F-150 (available from NEOS), and the like.

Examples of cationic surfactants are aliphatic primary, secondary or tertiary amines having a fluoroalkyl group, quaternary ammonium salts of fatty acids such as perfluoroalkyl (C6 to C10) sulfonamide propyl trimethyl ammonium salt, and the like; benzalkonium salts, benzetonium chloride, pyridinium chloride and imidazolinium salts, examples of commercial products being Surflon S-121 (available from Asahi Glass Co., Ltd.), Fluorad FC-135 (available from Sumitomo 3M). Unidyne DS-202 (available from Daikin Industries, Ltd.), Megaface F-150, Megaface F-824 (available from Dainippon Ink and Chemicals Incorporated), Eftop EF-132 (available from JEMCO Inc.), FTERGENT F-300 (available from NEOS), and the like.

Inorganic compound dispersants unlikely to be dissolved in water such as tricalcium phosphate, calcium carbonate, titanium oxide, colloidal silica, hydroxyapatite, and the like can also be used.

The dispersion droplets may also be stabilized by a polymer protecting colloid.

Examples thereof are acids such as acrylic acid, methacrylic acid, α-cyanoacrylic acid, α-cyanomethacrylic acid, itaconic acid, crotonic acid, fumaric acid, maleic acid, maleic anhydride, and the like; (meth)acrylic monomers which contain hydroxyl groups such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl methacrylic acid, diethylene glycol monoacrylic acid ester, diethylene glycol monomethacrylic acid ester, glycerine monoacrylic acid ester, glycerine monomethacrylic acid ester, N-methyloylacrylamide, N-methyloylmethacrylamide, and the like; vinyl alcohol or ether of vinyl alcohol such as vinyl methyl ether, vinyl ethyl ether and vinyl propyl ether, esters of compounds containing a carboxylic group with vinyl alcohol such as vinyl acetate, vinyl propionate and vinyl butyrate, acrylamide, methacrylamide, diacetone acrylamide, methyloyl compounds thereof, and the like; acid chlorides such as acrylic acid chloride and methacrylic acid chloride, homopolymers and copolymers containing a nitrogen atom or its heterocyclic ring such as vinyl pyridine, vinyl pyrrolidine, vinyl imidazole, ethyleneimine, and the like; polyoxyethylene compounds such as polyoxthylene, polyoxypropylene, polyoxyethylene alkylamine, polyoxyethylene propylamine, polyoxyethylene alkylamide, polyoxypropylene alkylamide, polyoxyethylene nonyl phenyl ether, polyoxyethylene lauryl phenyl ether, polyoxyethylene stearyl phenyl ether, polyoxyethylene nonyl phenyl ester, and the like; celluloses such as methyl cellulose, hydroxyethyl cellulose, hydroxypropyl cellulose, and the like; and the like.

When a substance such as calcium phosphate which is soluble in acid or alkali is used as a dispersion stabilizer, the calcium phosphate or other substance is dissolved using acid such as hydrochloric acid and the like, and calcium phosphate is then removed from the particles by rinsing with water. It may also be removed by enzymatic decomposition.

When a dispersant is used, the dispersant may be left on the surface of the toner. From the viewpoint of charging toner, it is preferred to remove the dispersant by washing after elongation and cross-linking reaction.

Moreover, for decreasing the viscosity of the toner composition, a solvent capable of dissolving the modified polyester resin (i) and the prepolymer (A) may be used.

Use of the solvent is more preferable in view of more sharpening of the graininess distribution. Moreover, the solvent is preferred to have a boiling point less than 100° C. (volatile) in view of easy removal.

Examples of the solvent include toluene, xylene, benzene, carbon tetrachloride, methylene chloride, 1,2-dichloroethane, 1,1,2-trichloroethane, trichloro ethylene, chloroform, monochloro benzene, dichloro ethylidene, methyl acetate, ethyl acetate, methyl ethyl ketone, methyl isobutyl ketone. The above may be used alone or in combination of two or more.

Especially preferable are aromatic solvents such as toluene, xylene and the like; and halogenated hydrocarbons such as methylene chloride, 1, 2-dichloroethane, chloroform, carbon tetrachloride and the like.

Typically, the consumed quantity of the solvent to the prepolymer (A) 100 mass parts is preferably 0 mass part to 300 mass parts, more preferably 0 mass part to 100 mass parts, and especially preferably 25 mass parts to 70 mass parts.

The solvent used is to be removed under an ordinary pressure or a decreased pressure, after the elongating or the cross-linking.

Reaction time for the elongation and reaction time for the cross-linking are selected according to the reactivity of the combination of the isocyanate group in the prepolymer (A) and the amines (B), and it is typically 10 minutes to 40 hours, and is preferably 2 hours to 24 hours.

The reaction temperature is typically 0° C. to 150° C., and is preferably 40° C. to 98° C.

A catalyst known in the art may also be used when required. Specific examples thereof are dibutyl tin laurate, dioctyl tin laurate, and the like.

For obtaining a desired shape, the following operations may be taken before removing the solvent from the dispersing liquid (reaction liquid) obtained after the elongating reaction and cross-linking reaction: i) by using, for the dispersing liquid, an apparatus provided with a homomixer, an Ebara Milder, a stirring vessel (having a stirrer) and the like which impart shearing force, deform the substantially spherical particle into a spindle, ii) then, remove the solvent from the dispersing liquid at the binder resin's glass transition point Tg or less, and iii) solidify the particle, to thereby prepare the desired-shaped toner.

Examples of methods of adjusting the shearing force include the apparatus's treating time, the number of treatments, the dispersing liquid's temperature, the dispersing liquid's viscosity, density of the organic solvent in the particle, and the like.

Moreover, depending on difference in the coating ratio of the resin fine particle of the particle surface, difference in reactivity with the compound having the active hydrogen group, and the like, the particle itself may vary its deformation by the shearing force, causing difference in the obtained shape.

To remove the organic solvent from the thus obtained emulsified dispersion, the temperature of the whole system is gradually raised, and the organic solvent in the liquid droplets is completely removed by evaporation. Alternatively, the emulsified dispersion is sprayed into a dry atmosphere to completely remove the water-insoluble organic solvent in the liquid droplets and form toner particles, and aqueous dispersant is removed at the same time by evaporation.

The dry atmosphere into which the emulsified dispersion is sprayed, is generally a heated gas such as air, nitrogen, carbon dioxide and combustion gas, the gas flow heated to a temperature above the boiling point of the highest-boiling point solvent being used. The desired product quality can be obtained in a short time by using a spray dryer, belt dryer, rotary kiln, and the like.

Moreover, for imparting shape, use of the solid fine particle dispersant for the manufacturing method having a volume contracting operation (volume contraction ratio 10% to 90% in the aqueous medium) is important.

Herein, the volume contraction ratio is expressed by "volume contraction ratio=$(1-Vt/Vo)\times 100$" where Vo denotes a volume of the oil phase (dispersion phase) in which the toner composition before the emulsification-dispersion in the aqueous medium is dispersed, and Vt denotes a volume of the dispersion phase after the emulsification-dispersion and the removal of volatile composition, to thereby measure the property change before the emulsification and after the granulation via the emulsification-dispersion.

Specifically, the volume contraction ratio may be obtained by the following method.

(1) Before the emulsion, measure the oil phase's weight, the toner's weight and the toner's true specific weight relative to the oil phase.

(2) Measure i) an average particle diameter of liquid drops after emulsification-dispersion in the aqueous medium and ii) an average particle diameter of particles with the volatile composition removed, followed by conversion into volume.

The volume contraction ratio is preferably 10% to 90%, and more preferably 30% to 70%. Out of 10% to 90% may make the particle shape indefinite, which is not preferable.

When the particle size distribution during the emulsification-dispersion is large, and washing and drying are performed while maintaining this particle size distribution, the particle size distribution can be desirably adjusted by classification.

The classification is performed by removing the fine particles in the liquid using a cyclone, decanter, centrifugal separation, and the like. The classifying can naturally be performed after obtaining the dry powder. It is preferred from the viewpoint of efficiency to perform the classifying in the liquid.

The unnecessary toner particles, either too small or too large, can be recycled to the melting-kneading operation to form new toner particles. In that case, the unnecessary toner particles may be wet.

It is preferred that the dispersant is removed from the obtained dispersion as much as possible, and this is preferably done at the same time as the classifying described above.

The obtained toner powders after drying may be mixed with other particles such as releasing agent, charge controlling agent, fluidity enhancer, colorant, and the like, and a mechanical impact may be imparted to the mixed powder so that the particles are fixed or fused on the surface to each other, to thereby prevent different particles from being separated from the surface of the obtained complex particles.

Specific methods for doing this include i) imparting an impact to the mixture by high-speed rotating blades, ii) introducing the mixture into a high-speed gas flow for acceleration so that the particles collide with each other or the complex particles are made to strike a proper impact plate, and the like.

The device used for this purpose may be an Angmill (available from Hosokawa Micron Corporation) or I-mill (available from Nippon Pneumatic Mfg. Co., Ltd.) that is modified to decrease the air pressure upon pulverizing, a Hybridization system (available from Nara Machinery Co., Ltd.), a Kryptron system (available from Kawasaki Heavy Industries), an automatic mortar, and the like.

(Developer)

The developer of the present invention comprises the toner of the present invention, and the other components such as carrier selected properly. The developer may be a single-component or a double-component developer; however, the developer is preferably of the double-component type in light of such factor as prolonged life, in order to be applied to high-speed printers for the purpose of nowadays-increased information processing rate.

Of the present invention, in the case of the single-component developer comprising the toner of the present invention, even after consumption and addition of the toner, the variation of the toner particle diameter is minimized, filming of the toner to a development roller is prevented, and toner fusion to members such as a toner blade which makes the toner layer thinner is prevented, and the developing properties and the images may be excellent and stable even after the developing device is utilized (stirred) for a long time. Moreover, with the double-component developer of the present invention, the fluctuation of toner particle diameter in the developer is decreased even after the consumption and addition of the toner is carried out for a long time, and good and stable development is achieved after a long-term agitation by a developing device.

The carrier is not specifically limited and therefore can be properly selected according to the object, those having a core material and a resin layer coating the core material are preferable.

The material for the core may be properly selected from conventional materials without particular limitations; for example, the material based on manganese-strontium (Mn—Sr) 50 emu/g to 90 emu/g and the material based on manganese-magnesium (Mn—Mg) are preferable, high magnetizing materials such as iron powder (100 emu/g or more) and magnetite (75 emu/g to 120 emu/g) are preferable from the standpoint of securing image density. Also, weak magnetizing materials such as of copper-zinc (Cu—Zn) (30 emu/g to 80 emu/g) are preferable from the standpoint of aiming higher-grade images by softening the contacts of the toner to the photoconductor where the toner is standing in a form of rice ear. Each of these materials may be employed alone or in combination.

The carrier preferably has an average particle diameter 10 μm to 45 μm. With the average particle diameter less than 10 μm, the carrier may be likely to be developed on the electrostatic latent image holding body (developed in combination with the toner), thereby damaging the electrostatic latent image holding body and the cleaning blade. With the average particle diameter less than 15 μm, however, the like tendency may be caused due to difference in the developing condition.

On the other hand, the carrier having the average particle diameter more than 45 μm may, especially in combination with the small particle diameter toner of the present invention, decrease the carrier's toner holding property, causing nonuniform solid image, toner scattering (flying), background shading and the like.

The material for the resin layer may be properly selected from conventional materials according to the object without particular limitations; examples of the material for the resin layer include amino resins, polyvinyl resins, polystyrene resins, halogenated olefin resins, polyester resins, polycarbonate resins, polyethylene resins, polyvinyl fluoride resins, polyvinylidene fluoride resins, polytrifluoro ethylene resins, polyhexafluoropropylene resins, copolymers of vinylidene fluoride with acrylic monomer, copolymers of vinylidene fluoride with vinyl fluoride, fluoroterpolymers such as the terpolymer of tetrafluoroethylene, vinylidene fluoride and a non-fluoride monomer, and silicone resins. These resins may be used alone or in combination of two or more.

The amino resins include, for example, urea-formaldehyde resins, melamine resins, benzoguanamine resins, urea resins, polyamide resins, epoxy resins, and the like. The polyvinyl resins include acrylic resins, polymethyl methacrylate resins, polyacrylonitrile resins, polyvinyl acetate resins, polyvinyl alcohol resins, polyvinyl butyral resins, and the like. The polystyrene resins include polystyrene resins, styrene-acryl copolymer resins and the like. The halogenated olefin resins include polyvinyl chloride and the like. The polyester resins include polyethylene terephthalate resins, polybutylene terephthalate resins and the like.

The resin layer may contain such material as conductive powder when necessary; examples of the conductive powder including, metal powder, carbon black, titanium oxide, tin oxide, zinc oxide, and the like. These conductive powders preferably have an average particle diameter 1 μm or less. When the average particle diameter is more than 1 μm, it may be difficult to control electrical resistance.

The resin layer may be formed by first dissolving the silicone resins into a solvent to prepare a coating solution, then uniformly coating the surface of the core material with the coating solution by known methods such as immersion method, spray method, brush painting method and the like, and baking it after drying.

There is no particular limitation on the solvent and therefore the solvent may be selected suitably from toluene, xylene, methyl ethyl ketone, methyl isobutyl ketone, celsorbutyl acetate, and the like.

The baking method may be an externally heating method or an internally heating method, and can be selected from, for example, a method using either a fixed type electric furnace, fluid type electric furnace, rotary type electric furnace, and burner furnace, or method of using microwave and the like.

The ratio of the resin layer (resin coating amount) in the carrier is preferably 0.01% by mass to 5.0% by mass relative to the entire amount of the carrier. When the ratio is less than 0.01% by mass, it is difficult to form a uniform resin layer on the surface of the core, meanwhile, when the ratio is more than 5.0% by mass, the resin layer becomes too thick and granulation of carriers may be caused. As a result, the uniform carrier of fine particles may not be obtained.

When the double-component developer is used, the contents of the carrier in the double-component developer is not specifically limited and may be properly selected according to the object, for example it is preferably 90% by mass to 98% by mass, and more preferably 93% by mass to 97% by mass.

Mixture ratio of the toner to the carrier in the double-component developer, as toner density in the developer, is 2% to 30%, and preferably 3% to 9%. The toner density less than 2% may decrease the image density thereby leading to a practical problem, while the toner density more than 9% may increase the background shading and toner's spattering (flying) in the developing machine thereby decreasing lifetime of the developer.

Since the developer of the present invention comprises the toner of the present invention, both of the offset property and the heat preservability may be excellent, and images of high quality may be formed stably.

The toner of the present invention may be used for image formation by various known electrophotographic methods such as magnetic single-component developing method, non-magnetic single-component developing method, double-component developing method, and the like. The toner of the present invention may be especially preferably used for the following toner container, process cartridge, image forming apparatus and image forming method.

(Toner Container)

A toner container of the present invention contains therein a toner and a developer of the present invention.

The toner container is not specifically limited, and it can be properly selected from those known in the art. Proper examples include a toner container including a main body and a cap.

The main body of the toner container is not specifically limited with regards to its size, shape, structure, material, and the like, and can be properly selected according to the object. For example, a cylinder shape is preferable. By forming spiral depressions-protrusions on the inner surface of the cylinder, a rotation of the cylinder can move the toner that is contained in the cylindrical container toward an outlet. It is especially preferable when a part or entirety of the spiral depressions-protrusions have a function of bellows.

The material for the toner container is not specifically limited, and those having dimensional accuracy are preferable. For example, resins can be used. Among resins, polyester resin, polyethylene resin, polypropylene resin, polystyrene resin, polyvinyl chloride resin, polyacrylic acid resin, polycarbonate resin, ABS resin, polyacetal resin, and the like are preferable.

Of the present invention, storing, transporting and the like of the toner container are simple, and handling property of the toner container is excellent. The toner container can be detachably fixed to the process cartridge, the image forming apparatus, and the like of the present invention, and can properly be used for supplying the toner.

Hereinafter described are specific examples of the present invention. The present invention is, however, not limited thereto. The term "part" denotes mass part.

1) Preparation of Photoconductor (1) Photoconductor A

On to a support which is an aluminum drum having thickness 0.8 mm, diameter 100 mm, a coating solution for undercoat layer, a coating solution for electric charge generating layer, a coating solution for electric charge transporting layer which have the following compositions were sequentially applied and dried, to thereby respectively form an undercoat layer 3.5 μm, an electric charge generating layer 0.3 μm, and an electric charge transporting layer 35 μm.

Then, on to the electric charge transporting layer, a top surface protective layer coating solution having the following composition was applied with a spray, locating a photoconductor top surface layer of 10 μm, to thereby prepare an electrophotographic photoconductor A of the present invention.

| [Coating solution for undercoat layer] | |
|---|---|
| Alkyd resin (Beckosol 1307-60-EL, made by Dainippon Ink and Chemicals, Incorporated) | 10 parts |

-continued

| [Coating solution for undercoat layer] | |
|---|---|
| Melamine resin (Super Beckamine G-821-60, made by Dainippon Ink and Chemicals, Incorporated) | 7 parts |
| Titanium oxide (CR-EL, made by Ishihara Sangyo Kaisha, Ltd.) | 40 parts |
| Methyl ethyl ketone | 200 parts |

| [Coating solution for electric charge generating layer] | |
|---|---|
| titanyl phthalocyanine (made by Ricoh Company, Ltd.) | 20 parts |
| Polyvinyl alcohol (S-LEC B BX-1, made by Sekisui Chemical Co., Ltd.) | 10 parts |
| Methyl ethyl ketone | 100 parts |

| [Coating solution for electric charge transporting layer | |
|---|---|
| Polycarbonate resin (Pan Light TS-2050, made by Teijin Chemicals Ltd.) | 10 parts |
| Low molecular electric charge transporting material having the following structure | 9.5 parts |

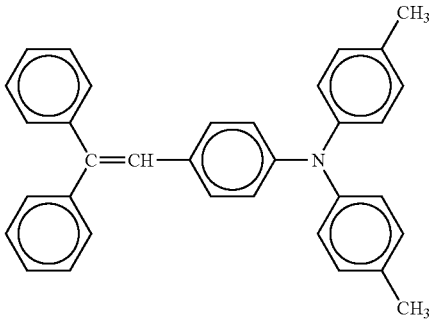

| | |
|---|---|
| Stabilizer having the following structure | 0.5 part |

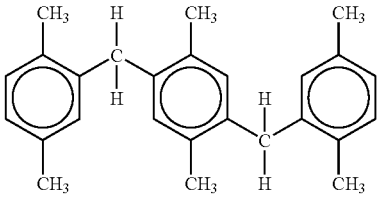

| | |
|---|---|
| Tetrahydrofuran | 79 parts |
| 1% silicone oil (KF50-100CS made by Shin-Etsu Chemical Co., Ltd.) | |
| Tetrahydrofuran solution | 1 part |

| [Coating solution for top surface protective layer] | |
|---|---|
| Low molecular electric charge transporting material having the following structure | 3 parts |

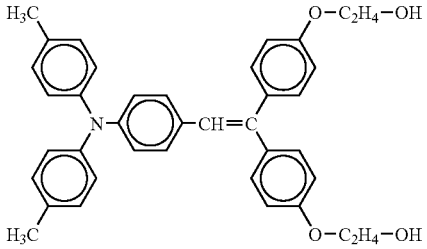

| | |
|---|---|
| Silicone-modified fluorine surfactant (ZX-007C, made by Fuji Kasei Kogyo Co., Ltd.) | 10.0 parts (solid content: 3.5 parts) |
| Melamine resin (Super Beckamine G-821-60, made by Dainippon Ink and Chemicals, Incorporated) | 5.8 parts (solid content: 3.5 parts) |
| Tetrahydrofuran | 150 parts |
| Cyclohexanone | 50 parts |

(2) Photoconductor B

Preparation of the Photoconductor a was Likewise Carried Out, Except that the surface protective layer was not provided, to thereby prepare the photoconductor B.

(3) Photoconductor C

Preparation of the Photoconductor a was Likewise Carried Out, Except that the surface protective layer coating solution was changed to the following, to thereby prepare the photoconductor C:

2) Preparation of Toner (1) Preparation of Toner A 1-(Synthesis of Organic Fine Particle Emulsion)

Into a reaction receptacle provided with a stirring rod and a thermometer, water 683 parts, sodium salt of ethylene methacrylate oxide adduct sulfuric acid ester (Eleminol RS-30, made by Sanyo Chemical Industries, Ltd.) 11 parts, styrene 83 parts, methacrylic acid 83 parts, butyl acrylate 110 parts, ammonium persulfate 1 part were introduced, followed by stirring at 400 rpm (revolutions per minute) for 15 minutes, to thereby obtain white color emulsion.

Then, heating was carried out, followed by increasing of in-system temperature to 75° C. for reaction for 5 hours. Moreover, 1% ammonium persulfate solution 30 parts was added, followed by ripening at 75° C. for 5 hours, to thereby obtain an aqueous dispersing liquid [fine particle dispersing liquid 1] of vinyl resin (copolymer of sodium salt of styrene-methacrylic acid-butyl acrylate-ethylene methacrylate oxide adduct sulfuric acid ester).

The [fine particle dispersing liquid 1] was measured with LA-920, having a weight average particle diameter 0.10 μm.

Part of the [fine particle dispersing liquid 1] was dried to thereby separate resin content alone. The thus separated resin content showed glass transition temperature (Tg) 57° C.

2-(Preparation of Liquid Phase)

Water 990 parts, [fine particle dispersing liquid 1] 80 parts, dodecyl diphenylether disodium sulfonate 48.5% solution (Eleminol MON-7: made by Sanyo Chemical Industries, Ltd.) 40 parts, ethyl acetate 90 parts were mixed and stirred, to thereby obtain an opalescent liquid. This is defined as [liquid phase 1].

| [Surface protective layer coating solution] | |
|---|---|
| Polycarbonate resin (Iupilon Z200: made by Mitsubishi Gas Chemical Company, Inc.) | 3.8 parts |
| Electric charge transporting material in the structural formula | 2.8 parts |

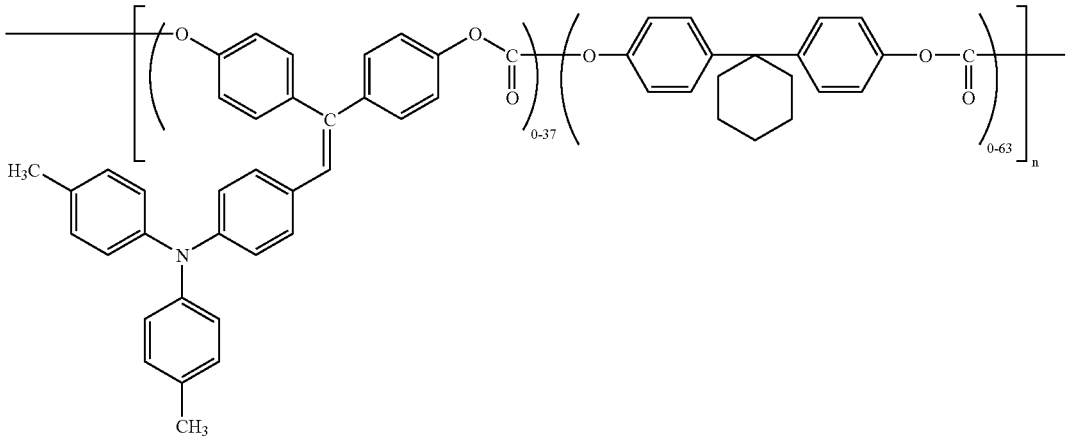

| | |
|---|---|
| α-alumina fine particle (specific resistance: $2.5 \times 10^{12}$ Ω · cm, average primary particle diameter: 0.5 μm) | 2.6 parts |
| Cyclohexanone | 80 parts |
| Tetrahydrofuran | 280 parts |

3-(Synthesis of Low Molecular Polyester)

Into a reaction receptacle provided with a cooling pipe, a stirrer and a nitrogen introduction pipe, ethyleneoxide 2 mol adduct of bisphenol A 220 parts, propylene oxide 3 mol adduct of bisphenol A 561 parts, terephthalic acid 218 parts, adipic acid 48 parts and dibutyl tin oxide 2 parts were introduced, followed by reaction under an ordinary pressure at 230° C. for 8 hours.

Moreover, the reaction was carried out under a decreased pressure 10 mmHg to 15 mmHg for 5 hours, then trimellitic anhydride 45 parts was introduced in the reaction receptacle, 180° C., followed by the reaction under an ordinary pressure for 2 hours, to thereby obtain [low molecular polyester 1].

The [low molecular polyester 1] showed number average molecular weight 2500, weight average molecular weight 6700, Tg 43° C., and acid value 25 mgKOH/g.

4-(Synthesis of Prepolymer)

Into a reaction receptacle provided with a cooling pipe, a stirrer and a nitrogen introduction pipe, ethyleneoxide 2 mol adduct of bisphenol A 682 parts, propylene oxide 2 mol adduct of bisphenol A 81 parts, terephthalic acid 283 parts, trimellitic anhydride 22 parts and dibutyl tin oxide 2 parts were introduced, followed by a reaction under an ordinary pressure at 230° C. for 8 hours.

Moreover, the reaction was carried out under a decreased pressure 10 mmHg to 15 mmHg for 5 hours, to thereby obtain [intermediate polyester 1].

The [intermediate polyester 1] showed number average molecular weight 2100, weight average molecular weight 9500, glass transition temperature (Tg) 55° C., acid value 0.5, and hydroxyl group value 49.

Then, into a reaction receptacle provided with a cooling pipe, a stirrer and a nitrogen introduction pipe, the [intermediate polyester 1] 411 parts, isophorone diisocyanate 89 parts, and ethyl acetate 500 parts were introduced, followed by reaction at 100° C. for 5 hours, to thereby obtain [prepolymer 1].

The [prepolymer 1] had a free isocyanate 1.53% by mass.

5-(Synthesis of Ketimine)

Into a reaction receptacle provided with a stirring rod and a thermometer, isophorone diamine 170 parts and methyl ethyl ketone 75 parts were introduced, followed by a reaction at 50° C. for 5 hours, to thereby obtain [ketimine compound 1]. The [ketimine compound 1] showed amine value 418.

6-(Synthesis of Master Batch)

Carbon Black (Regal 400R made by Cabot Corporation): 40 parts, binder resin: polyester resin (RS-801 acid value 10, Mw 20,000, Tg 64° C., made by Sanyo Chemical Industries, Ltd.): 60 parts, and water: 30 parts were mixed by using Henschel mixer, to thereby obtain a mixture with the water impregnated in a pigment aggregate.

The thus obtained mixture was mixed-kneaded for 45 minutes with two rollers having roll's surface temperature 130° C., followed by pulverizing into 1 mmϕ with a pulverizer, to thereby obtain [master batch 1].

7-(Preparation of Oil Phase)

Into a receptacle provided with a stirring rod and a thermometer, [low molecular polyester 1] 378 parts, carnauba wax 110 parts, CCA (salicylic acid metal complex E-84: made by Orient Chemical Industries) 22 parts, ethyl acetate 947 parts were introduced, followed by increasing temperature to 80° C. under stirring, followed by being left at rest at 80° C. for 5 hours, and followed by cooling for 1 hour at 30° C.

Then, into the receptacle, the [master batch 1] 500 parts and ethyl acetate 500 parts were introduced, followed by mixing for 1 hour, to thereby obtain [raw material solution 1].

The [raw material solution 1] 1324 parts was transferred to the receptacle, then, 0.5 mm zirconia beads 80% by volume were loaded using beads mill (ultra beads mill, made by Imex) under conditions of liquid-conveying speed 1 kg/hr, disk circumferential speed 6 m/second, 3 pass, to thereby disperse carbon black and wax.

Then, 65% ethyl acetate solution 1324 parts of the [low molecular polyester 1] was added, followed by 1 pass with the beads mill under the above conditions, to thereby obtain [pigment-wax dispersing liquid 1].

The [pigment-wax dispersing liquid 1] showed solid content density (130° C., 30 minutes) 50%.

8-(Emulsification)

The [pigment-wax dispersing liquid 1] 648 parts, [prepolymer 1] 154 parts, and [ketimine compound 1] 6.6 parts were introduced into a receptacle, followed by mixing by using TK homomixer (made by Tokushu Kika Kogyo Co., Ltd.) at 5,000 rpm for 1 minutes, followed by adding [liquid phase 1] 1200 parts into the receptacle, and followed by mixing by using TK homomixer at rotation speed 13,000 rpm for 20 minutes, to thereby obtain [emulsification slurry 1].

9-(Heteromorphy)

Ion exchange water 1365 parts, carboxy methyl cellulose (CMC DAICEL-1280: made by Daicel Chemical Industries, Ltd.) 35 parts were introduced into a receptacle and were stirred, to thereby obtain a solution. In the above solution, the [emulsification slurry 1] 1,000 parts were mixed, followed by mixing by using TK homomixer (made by Tokushu Kika Kogyo Co., Ltd.) at 2,000 rpm for 1 hour, to thereby obtain [heteromorphic slurry 1].

10-(Removal of Solvent)

Into a receptacle provided with a stirrer and a thermometer, the [heteromorphic slurry 1] was introduced, followed by removal of solvent at 30° C. for 8 hours, and followed by ripening at 45° C. for 4 hours, to thereby obtain [dispersion slurry 1].

11-(Cleaning→drying→toner Matrix A)

After the [dispersion slurry 1] 100 parts was subjected to a decreased pressure filtering, (1): Ion exchange water 100 parts was added to a filter cake, followed by mixing (at rotation speed 12,000 rpm for 10 minutes) by using TK homomixer, to thereafter carry out filtering.

(2): 10% sodium hydroxide solution 100 parts was added to the filter cake of (1), followed by mixing (at rotation speed 12,000 rpm for 30 minutes) by using TK homomixer with an ultrasonic wave vibration applied, to thereafter carry out decreased pressure filtering. The above ultrasonic wave alkali cleaning was carried out again (two ultrasonic wave alkali cleanings).

(3): To the filter cake of (2), 10% hydrochloric acid 100 parts was added, followed by mixing (at rotation speed 12,000 rpm for 10 minutes) by using TK homomixer, to thereafter carry out the filtering.

(4): To the filter cake of (3), ion exchange water 300 parts was added, followed by mixing (at rotation speed 12,000 rpm for 10 minutes) by using TK homomixer, and followed by two filtering operations, to thereby obtain [filter cake 1]. The [filter cake 1] was dried with a circulating wind drier at 45° C. for 48 hours, followed by sieving with a mesh having opening 75 μm, to thereby obtain [toner matrix A].

12-(Completion of Toner A)

To the [toner matrix A] 100 mass parts, hydrophobic silica (average primary particle diameter 15 nm fine particle) 3.0 parts was added, and the resultant was mixed by using Henschel mixer at 1500 rpm, to thereby obtain the toner A.

For arbitrarily deforming the toner matrix's shape, ordinarily, an emulsifying-dispersing liquid (oil phase) is mixed with a high-viscosity solution (liquid phase) which is added by viscosity promoter, activator and the like, then, the resultant mixed solution is to be subjected to a shearing apparatus such as homomixer, Ebara Milder and the like, to thereby deform an emulsified particle by using viscosity difference between the oil phase and the liquid phase.

Conditions for deforming the toner's matrix shape include hydrophilic organic solvent's density in the oil phase, temperature in the oil phase, viscosity promoter in the liquid phase, activator in the liquid phase, temperature in the liquid phase. By adjusting the above conditions, the viscosity difference between the oil phase and the liquid phase can be adjusted, to thereby deform the toner's matrix shape.

The toner's matrix shape can be controlled by a method of adjusting the shearing force of the apparatus, examples of the method including a treating apparatus's shape, treatment time, the number of treatments and treatment temperature.

With the conditions varied as described above, the toner matrix A's shape was arbitrarily varied, to thereby prepare a toner matrix B, a toner matrix C, a toner matrix D, and a toner matrix E.

Addition amount of hydrophobic silica of the thus obtained toner matrix A to toner matrix D were varied, to thereby obtain a toner A to a toner F.

Moreover, into the toner matrix D and the toner matrix E, hydrophobic silica 1.2 parts and hydrophobic titanium dioxide (average primary particle diameter 15 nm) 0.3 part were mixed, to thereby obtain a toner G (in total 1.5 parts as an inorganic fine particle addition amount). Table 1 shows the results in combination with material property.

The toner's shape factor SF-2 was calculated by the following equation (2).

$$SF-2=\frac{(PERI)^2}{\text{AREA}}\times\frac{\pi}{4}\times 100 \qquad \text{Equation (2)}$$

The toner's shape factor SF-1 was calculated by the following equation (3).

$$SF-1=\frac{(MXLNG)^2}{\text{AREA}}\times\frac{\pi}{4}\times 100 \qquad \text{Equation (3)}$$

Moreover, an effective inorganic fine particle amount was calculated by the following equation (1).

$$\text{Effective inorganic particle amount}(\%)=\frac{\text{Inorganic particle amount}(\%)}{SF-2/100} \qquad \text{Equation (1)}$$

In the equation (1), SF-2 denotes the toner's shape factor.

TABLE 1

| | | Inorganic fine particle added (% by weight) | SF-2 | SF-1 | Effective inorganic fine particle (% by weight) |
|---|---|---|---|---|---|
| Toner A | Toner matrix A | 3.0 | 109 | 180 | 2.75 |
| Toner B | Toner matrix B | 1.1 | 130 | 137 | 0.83 |
| Toner C | Toner matrix A | 0.8 | 109 | 180 | 0.73 |
| Toner D | Toner matrix A | 3.5 | 109 | 180 | 3.21 |
| Toner E | Toner matrix C | 1.0 | 115 | 155 | 0.87 |
| Toner F | Toner matrix D | 1.5 | 117 | 143 | 1.28 |
| Toner G | Toner matrix D | 1.5 | 117 | 143 | 1.28 |
| Toner H | Toner matrix E | 1.5 | 155 | 170 | 0.97 |

3) Preparation of Carrier

| | |
|---|---|
| Core material: Cu—Zn ferrite (average particle diameter 50 μm) | 5,000 parts |
| Coating solution: silicone resin (SR2410, made by Dow Corning Toray Silicone Co., Ltd., nonvolatile content 23%) | 450 parts |
| γ-(2-aminoethyl) aminopropyl trimethoxy silane (SH6020, made by Dow Corning Toray Silicone Co., Ltd.) | 9 parts |
| Conductive carbon black (Black Perls 2000, made by CABOT) | 11 parts |
| Toluene | 450 parts |

Using a coating apparatus for coating by forming a revolving flow with a rotary base plate disk in a fluidized bed turned at high speed, the coating solution was applied on to the carrier core material in such a manner as to have film thickness 0.8 μm. Thereafter, the resultant was heated with an electric furnace at temperature 300° C. for 1 hour, to thereby prepare the carrier A.

The carrier A showed magnetization 53 emu/g at 1,000 oersted.

(2) Carrier B

Preparation of the Carrier a was Likewise Carried Out, Except that the carrier's core material was changed to magnetite (average particle diameter 50 μm), to thereby prepare the carrier B. The carrier B showed magnetization 82 emu/g at 1,000 oersted.

Particle diameter distribution of the carrier A and the carrier B was measured with micro track (Model HRA9320-X100: made by Honewell). The results are shown in Table 2.

TABLE 2

| | Carrier A | Carrier B |
|---|---|---|
| Average particle diameter (μm) | 50 | 50 |
| 88 μm or more (% by weight) | 10.6 | 4.5 |
| 62 μm or more (% by weight) | 31.5 | 40.2 |
| 22 μm or more (% by weight) | 4.7 | 5.2 |
| 16 μm or more (% by weight) | 3.3 | 1.5 |

Then, to an image forming apparatus mounted to imagio Neo 1050 Pro made by Ricoh Company, Ltd., a developing apparatus having a developing sleeve (sleeve surface magnetic flux density of main magnetic pole center: 90 mT) in FIG. 2 was installed, such that the toner, the carrier and the photoconductor were installed in the combinations described in the following Table 3. Under a condition of continuously printing 999 pieces of character image charts each having pixel density 600 dpi×600 dpi and image area 6%, the printing was outputted to copy paper (My paper, made by Ricoh Company, Ltd.), to thereby evaluate the following items. Results are shown in Table 4.

In other words, as shown in Table 1, the toner A 5 parts (to the toner G 5 parts) in combination with the carrier B95 parts were mixed by using TURBULAR mixer, to thereby prepare the developers. Moreover, the photoconductor A, the photoconductor B, and the photoconductor C were combined for the example 1 to the example 7 and the comparative example 1 to the comparative example 4.

TABLE 3

| | | | |
|---|---|---|---|
| Example 1 | Toner A | Carrier A | Photoconductor A |
| Example 2 | Toner A | Carrier B | Photoconductor A |
| Example 3 | Toner B | Carrier B | Photoconductor A |
| Example 4 | Toner E | Carrier B | Photoconductor A |
| Example 5 | Toner F | Carrier B | Photoconductor A |
| Example 6 | Toner G | Carrier B | Photoconductor A |
| Example 7 | Toner H | Carrier B | Photoconductor A |
| Comparative example 1 | Toner A | Carrier B | Photoconductor B |
| Comparative example 2 | Toner A | Carrier B | Photoconductor C |
| Comparative example 3 | Toner C | Carrier B | Photoconductor A |
| Comparative example 4 | Toner D | Carrier B | Photoconductor A |

(1) Filming Property

Running output of 200,000 pieces was followed by high temperature high humidity environment (30° C., 80% RH), and followed by running output 5,000 pieces, to thereafter observe the surface of the photoconductor and visually evaluate the filming state from 1×1 half tone image.

A: No filming

B: Slight filming, but not appearing on image

C: Remarkable filming, half tone image whitened through (not acceptable)

(2) Decreased Wear Amount

After running output of 500,000 pieces, film thickness of the photoconductor drum was measured, to thereby calculate the photoconductor wear amount based the difference from the initial amount.

(3) Background Shading

After running output of 200,000 pieces, the white paper original was outputted, to thereby visually evaluate the background shading.

TABLE 4

| | Filming | Photoconductor wear amount (μm) | Background shading |
|---|---|---|---|
| Example 1 | B | 2.6 | B |
| Example 2 | B | 2.4 | B |
| Example 3 | A | 2.3 | B |
| Example 4 | B | 2.3 | B |
| Example 5 | A | 1.9 | B |

TABLE 4-continued

| | Filming | Photoconductor wear amount (μm) | Background shading |
|---|---|---|---|
| Example 6 | A | 1.5 | A |
| Example 7 | A | 2.0 | A |
| Comparative example 1 | C | 4.5 | B |
| Comparative example 2 | B | 3.8 | C |
| Comparative example 3 | C | 2.5 | C |
| Comparative example 4 | B | 3.3 | C |

What is claimed is:

1. An image forming method, comprising:

forming a latent electrostatic image on a latent electrostatic image carrier;

developing the latent electrostatic image with a toner to thereby form a visible image; and fixing the image transferred to a recording medium, wherein the latent electrostatic image carrier comprises:

a support, a photoconductive layer on the support, and a surface protective layer on the support, wherein the surface protective layer comprises a reactant made by cross-linking the following:

an electric charge transporting material which comprises a reactive functional group, a cross-linking resin, and a fluorine surfactant, and wherein the toner comprises an inorganic fine particle which defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - \frac{2}{100}} \quad \text{Equation (1)}$$

wherein SF-2 denotes a shape factor of the toner.

2. The image forming method according to claim 1, wherein, the developing has a developing area where the latent electrostatic image carrier is opposed to a developer bearer bearing with a magnetic force a double-component developer which comprises the toner and a magnetic carrier, the magnetic force causes the toner and the magnetic carrier to stand, to thereby form a magnetic brush on the developer bearer, the magnetic brush slides on a surface of the latent electrostatic image carrier, to thereby visualize the latent electrostatic image on the latent electrostatic image carrier, and based on a main magnetic pole center the magnetic carrier has a magnetic flux density 50 mT or more of the developer bearer's surface, and has a weight average particle diameter 30 μm to 60 μm, causing a saturated magnetization in a range of 50 emu/g to 120 emu/g relative to an applied magnetic field 1,000 oersted.

3. The image forming method according to claim 1, wherein the latent electrostatic image carrier is caused to contact a charging member, to thereby apply a voltage to the charging member.

4. The image forming method according to claim 1, wherein an alternating electric field is applied for developing the latent electrostatic image on the latent electrostatic image carrier.

5. The image forming method according to claim 1, wherein the shape factor SF-2 of the toner is 110 to 140 calculated from the following equation (2):

$$SF-2=\frac{(PERI)^2}{\text{AREA}}\times\frac{\pi}{4}\times 100 \qquad \text{Equation (2)}$$

wherein the PERI is a peripheral length of a diagram formed by projecting the toner to a two-dimensional flat face, and the AREA is an area of the diagram formed by projecting the toner to the two-dimensional flat face.

6. The image forming method according to claim 1, wherein a shape factor SF-1 of the toner is 140 to 175 calculated from the following equation (3):

$$SF-1=\frac{(MXLNG)^2}{\text{AREA}}\times\frac{\pi}{4}\times 100 \qquad \text{Equation (3)}$$

wherein the MXLNG is a maximum length of a diagram formed by projecting the toner to a two-dimensional flat face, and the AREA is an area of the diagram formed by projecting the toner to the two-dimensional flat face.

7. The image forming method according to claim 1, wherein the inorganic fine particle of the toner is added in an amount of 1.0% by mass to 4.0% by mass.

8. The image forming method according to claim 7, wherein the inorganic fine particle is at least one selected from the group consisting of a hydrophobic silica, a hydrophobic titanium and a hydrophobic alumina.

9. The image forming method according to claim 7, wherein an average diameter of a primary particle of the inorganic fine particle is 10 nm to 100 nm.

10. A toner, comprising:

an inorganic fine particle, wherein the toner is used for developing a latent electrostatic image formed on a latent electrostatic image carrier which comprises:

a support, a photoconductive layer on the support, and a surface protective layer on the support, wherein the surface protective layer comprises a reactant made by cross-linking the following:

an electric charge transporting material which comprises a reactive functional group, a cross-linking resin, and a fluorine surfactant, and wherein the inorganic fine particle of the toner defines an effective inorganic fine particle amount in a range of 0.8% by mass to 3.0% by mass calculated from the following equation (1):

$$\text{Effective inorganic particle amount}(\%)=\frac{\text{Inorganic particle amount}(\%)}{SF-\frac{2}{100}} \qquad \text{Equation (1)}$$

wherein SF-2 denotes a shape factor of the toner.

11. The toner according to claim 10, wherein the toner is formed by the following:

dissolving-dispersing, in an organic solvent, a toner material which comprises:

an active hydrogen group-contained compound, and a polymer reactive with the active hydrogen group-contained compound, to thereby prepare a toner solution, emulsifying-dispersing the toner solution in an aqueous medium, to thereby prepare a dispersing liquid, reacting, in the aqueous medium, the active hydrogen group-contained compound with the polymer reactive with the active hydrogen group-contained compound, to thereby produce an adhesive base material in a form of a particle, and removing the organic solvent.

12. A double-component developer, comprising:

a magnetic carrier; and a toner which comprises:

an inorganic fine particle, wherein the toner is used for developing a latent electrostatic image formed on a latent electrostatic image carrier which comprises:

a support, a photoconductive layer on the support, and a surface protective layer on the support, wherein the surface protective layer comprises a reactant made by cross-linking the following:

an electric charge transporting material which comprises a reactive functional group, a cross-linking resin, and a flourine surfactant, and wherein the inorganic fine particle of the toner defines an effective inorganic fine particle amount in a range of 0.8% by mass to 3.0% by mass calculated from the following equation (1):

$$\text{Effective inorganic particle amount}(\%)=\frac{\text{Inorganic particle amount}(\%)}{SF-\frac{2}{100}} \qquad \text{Equation (1)}$$

wherein SF-2 denotes a shape factor of the toner.

13. The double-component developer according to claim 12, wherein the magnetic carrier has a distribution of a particle diameter in the following:

the particle diameter less than 22 μm is distributed by 0% to 15%, and the particle diameter more than 88 μm is distributed by 0% to 5%.

14. A toner container, comprising:

a toner loaded in the toner container, wherein the toner which comprises an inorganic fine particle is used for developing a latent electrostatic image formed on a latent electrostatic image carrier which comprises:

a support, a photoconductive layer on the support, and a surface protective layer on the support, wherein the surface protective layer comprises a reactant made by cross-linking the following:

an electric charge transporting material which comprises a reactive functional group, a cross-linking resin, and a fluorine surfactant, and wherein the inorganic fine particle of the toner defines an effective inorganic fine particle amount in a range of 0.8% by mass to 3.0% by mass calculated from the following equation (1):

$$\text{Effective inorganic particle amount}(\%) = \frac{\text{Inorganic particle amount}(\%)}{SF - \frac{2}{100}} \quad \text{Equation (1)}$$

wherein SF-2 denotes a shape factor of the toner.

* * * * *